US012588795B2

(12) United States Patent
Miller et al.

(10) Patent No.: US 12,588,795 B2
(45) Date of Patent: Mar. 31, 2026

(54) SURFACE CLEANING APPARATUS WITH SCRUB MODE

(71) Applicant: BISSELL Inc., Grand Rapids, MI (US)

(72) Inventors: Dean T. Miller, Wyoming, MI (US); Joshua Buck, Grand Rapids, MI (US); Eric Daniel Buehler, Grand Rapids, MI (US); David VanKampen, Grand Rapids, MI (US); Jeffery Swan, Ovid, MI (US); Matthew G. Kamps, Caledonia, MI (US); Brandon Arrendondo, Rockford, MI (US); Patryk D. Akhurst, Grand Rapids, MI (US); Todd R. VanTongeren, Ada, MI (US); Raghu Chandra Sekhar Babu Angara, Singapore (SG); Neil Edward Perez Onal, Singapore (SG); Dennis Lee, Singapore (SG)

(73) Assignee: BISSELL Inc., Walker, MI (US)

( * ) Notice: Subject to any disclaimer, the term of this patent is extended or adjusted under 35 U.S.C. 154(b) by 0 days.

(21) Appl. No.: 19/033,657

(22) Filed: Jan. 22, 2025

(65) Prior Publication Data

US 2025/0160596 A1 May 22, 2025

Related U.S. Application Data

(60) Provisional application No. 63/627,255, filed on Jan. 31, 2024.

(51) Int. Cl.
*A47L 11/40* (2006.01)
*A47L 9/04* (2006.01)

(52) U.S. Cl.
CPC ..... *A47L 11/4011* (2013.01); *A47L 9/0461* (2013.01); *A47L 11/4086* (2013.01)

(58) Field of Classification Search
CPC ..... A47L 11/00; A47L 11/28; A47L 11/282; A47L 11/408; A47L 11/4011;
(Continued)

(56) References Cited

U.S. PATENT DOCUMENTS 2,246,837 A 6/1941 Carlson
4,328,522 A 5/1982 Tryan
(Continued)

FOREIGN PATENT DOCUMENTS

CN 101238961 1/2011
CN 202004573 U * 10/2011
(Continued)

OTHER PUBLICATIONS

"Dreame H12 Dual—A Powerful 4-in-1 Cleaning Wizard." YouTube, Jul. 28, 2023, https://www.youtube.com/watch?v=_k4InObkPtl.
(Continued)

*Primary Examiner* — Katina N. Henson
*Assistant Examiner* — Sharonda T Felton
(74) *Attorney, Agent, or Firm* — Warner Norcross + Judd LLP

(57) ABSTRACT

A surface cleaning apparatus includes a supply tank, a fluid dispenser, a brushroll rotatable about an axis, a brushroll motor configured to rotate the brushroll in a forward direction about the axis and a backward direction about the axis, and a controller. The controller executes a scrub mode in which the brushroll is oscillated forward and backwards about the axis to scrub a surface to be cleaned and break up a stubborn stain on the surface.

30 Claims, 19 Drawing Sheets

(58) Field of Classification Search
CPC ..... A47L 11/4041; A47L 11/4063; A47L 11/4088; A47L 9/02; A47L 9/04; A47L 9/0405; A47L 9/0411; A47L 9/0461; A47L 9/2857; A47L 9/2831; A47L 9/2842; A47L 9/2847; A47L 11/20; A47L 11/201; A47L 11/30; A47L 11/302; B08B 5/34; B08B 5/043; A46B 13/02
See application file for complete search history.

(56) References Cited

U.S. PATENT DOCUMENTS

| | | | | |
|---|---|---|---|---|
| 4,447,930 | A | 5/1984 | Glenn, III et al. | |
| 4,457,042 | A | 7/1984 | Jones et al. | |
| 4,512,057 | A | 4/1985 | Laing et al. | |
| 4,951,346 | A | 8/1990 | Salmon | |
| 5,940,927 | A | 8/1999 | Haegermarck | |
| 6,848,147 | B2 | 2/2005 | Syverson et al. | |
| 7,712,183 | B2 | 5/2010 | Nakai et al. | |
| 8,020,236 | B2 * | 9/2011 | Kaleta | A47L 11/4041 15/88.4 |
| 8,881,339 | B2 | 11/2014 | Gilbert, Jr. | |
| 10,602,899 | B1 | 3/2020 | Afrouzi | |
| 10,716,440 | B2 | 7/2020 | Yoshida et al. | |
| 11,206,960 | B2 | 12/2021 | McRorie et al. | |
| 11,291,342 | B1 | 4/2022 | Afrouzi | |
| 2003/0188397 | A1 | 10/2003 | Syverson et al. | |
| 2004/0221415 | A1 * | 11/2004 | Tondra | A47L 9/2805 15/319 |
| 2010/0269857 | A1 | 10/2010 | Assmann et al. | |
| 2013/0056026 | A1 * | 3/2013 | Jung | A47L 9/0411 15/21.1 |
| 2017/0273526 | A1 | 9/2017 | Love et al. | |
| 2020/0315418 | A1 * | 10/2020 | Howard | A47L 9/1409 |
| 2021/0143769 | A1 * | 5/2021 | Fogarty, Jr. | A47L 5/365 |
| 2021/0245081 | A1 * | 8/2021 | Kumar | A47L 9/0494 |
| 2022/0338695 | A1 | 10/2022 | Zhou et al. | |
| 2023/0059781 | A1 * | 2/2023 | Lee | B08B 3/024 |
| 2023/0346186 | A1 * | 11/2023 | Nguyen | A47L 9/0477 |
| 2024/0180381 | A1 | 6/2024 | Dang et al. | |
| 2024/0216956 | A1 * | 7/2024 | Dong | A47L 11/282 |
| 2025/0107680 | A1 * | 4/2025 | Steeman | A47L 9/0411 |

FOREIGN PATENT DOCUMENTS

| | | |
|---|---|---|
| CN | 105025769 | 12/2016 |
| CN | 111493759 | 8/2020 |
| CN | 217040011 | 7/2022 |
| CN | 115089071 | 9/2022 |
| CN | 115363487 | 11/2022 |
| CN | 115381344 | 11/2022 |
| CN | 115486758 | 12/2022 |
| CN | 218484471 | 2/2023 |
| CN | 115844287 | 3/2023 |
| CN | 116250772 | 6/2023 |
| CN | 116327054 | 6/2023 |
| CN | 116369796 | 7/2023 |
| CN | 116421109 | 7/2023 |
| CN | 117100149 | 11/2023 |
| CN | 220109666 | 12/2023 |
| CN | 117481551 | 2/2024 |
| CN | 118076273 | 5/2024 |
| JP | 02034137 | 2/1990 |
| JP | 5199960 | 8/1993 |
| JP | 5293065 | 11/1993 |
| JP | 6254010 | 9/1994 |
| JP | 3334298 | 10/2002 |
| JP | 2003325397 | 6/2005 |
| JP | 2006110089 | 4/2006 |
| JP | 3855148 | 12/2006 |
| JP | 2006334084 | 12/2006 |
| JP | 6105886 | 3/2017 |
| JP | 2021087620 | 6/2021 |
| KR | 100492593 | 6/2005 |
| WO | 23221912 | 11/2023 |
| WO | 24012530 | 1/2024 |

OTHER PUBLICATIONS

"Tineco's Latest: The Tineco Floor One S7 FlashDry." Vacuum Wars, Aug. 9, 2024, https://vacuumwars.com/tinecos-latest-the-tineco-floor-one-s7-flashdry/.

* cited by examiner

SURFACE CLEANING APPARATUS WITH SCRUB MODE

CROSS-REFERENCE TO RELATED APPLICATION(S)

The present application claims priority to U.S. Provisional Application No. 63/627,255, filed Jan. 31, 2024, which is incorporated herein by reference in its entirety.

BACKGROUND

Surface cleaning apparatuses such as wet/dry floor cleaners, vacuum mops, and other floor cleaners are popular with many users because they can both vacuum and mop floors, are easy to maneuver, and require less storage space. However, one drawback of such floor cleaners is that stubborn stains, such as sticky spots, residues, heavily soiled areas, or other hard-to-clean spots are not removed by passing over the stains once or twice with the floor cleaner.

One prior art solution is for the user to move the apparatus back and forth over the stain until it is gone. A drawback of this solution is that it is time-consuming and requires that the user make several passes over the same spot. Even still, this method often does not fully remove stubborn stains, particularly if the user does not spend enough time in one spot or make enough passes over the spot. The user must then resort to cleaning the stain manually with towels or other tools. Providing floor cleaners with effective stain removal remains a challenge in the floor cleaning industry.

BRIEF SUMMARY

A surface cleaning apparatus is provided with an improved scrub mode.

In one aspect of the disclosure, a surface cleaning apparatus includes a housing including a suction inlet for drawing in liquid, debris and air, an agitator configured to rotate in a first direction and in a second direction to agitate the surface to be cleaned, a fluid delivery system configured to deliver a cleaning fluid, a motor operably coupled to the agitator, the motor being configured to rotate the agitator in the first direction and in the second direction, and a controller configured to operate the surface cleaning apparatus in each of a standard cleaning mode and a scrub mode, wherein the controller responds to activation of the scrub mode by initiating a plurality of bi-directional cleaning cycles for debris removal, and wherein each of the plurality of bi-directional cleaning cycles includes rotation of the agitator in the first direction for at least a first plurality of revolutions followed by a first braking interval and counter-rotation of the agitator in the second direction for at least a second plurality of revolutions followed by a second braking interval, and wherein the controller is operable to change at least one of a fluid delivery parameter and a suction parameter of the standard cleaning mode in response to activation of the scrub mode for providing agitation, cleaning fluid, and suction at the surface to be cleaned.

In some aspects, the controller transitions from the standard cleaning mode to the scrub mode by increasing agitator speed, increasing a flow rate of cleaning, decreasing suction at the suction inlet, or any combination thereof.

In some aspects, the scrub mode includes increasing the speed of the agitator in the first direction over a ramp interval and maintaining the speed until the first braking interval.

In some aspects, the scrub mode includes decreasing a cleaning fluid flow rate at least once, increasing the flow rate at least once, deactivating a pump after a first period of dispensing cleaning fluid, ramping up to a first pump flow rate and thereafter deactivating the pump during a remainder of the scrub mode, varying the pump flow rate between a first flow rate and a second flow rate that is lower than the first flow rate, dispensing cleaning fluid at a first flow rate for a first period of time, ramping down to dispense cleaning fluid at a second flow rate that is less than the first flow rate, maintaining the second flow rate a second period of time, and thereafter ramping up to dispense cleaning fluid at the first flow rate, or any combination thereof.

In some aspects, the scrub mode includes ramping suction down from first suction level to a second, lower suction level, decreasing a suction level at least once, increasing a suction level at least once, varying suction between a first suction level and a second suction level that is less than the first suction level, outputting a first suction level for a first period of time, ramping down to a second suction level that is less than the first suction level, maintain the second suction level a second period of time, ramping up to the first suction level, and maintaining the first suction level for a third period of time, or any combination thereof.

In another aspect, the scrub mode includes oscillating the agitator forward and backwards about the axis a plurality of times to scrub a surface to be cleaned, wherein oscillating the agitator forward comprises rotating the agitator in a first direction about the axis by ramping up agitator speed to a first speed, maintaining the first speed for a first period of time, and thereafter ramping down agitator speed to zero, and wherein oscillating the agitator backward comprises rotating the agitator in a second direction about the axis by ramping up agitator speed to a second speed, maintaining the second speed for a second period of time, and thereafter ramping down agitator speed to zero.

In a further aspect, the scrub mode includes oscillating the agitator forward in the first direction about the axis and backward in the second direction about the axis to scrub a surface to be cleaned, wherein oscillating the agitator comprises automatically switching the rotational direction of the agitator at least every 0.5 seconds or less for the duration of the scrub mode In yet another aspect, the scrub mode includes oscillating the agitator forward and backwards about the axis to scrub a surface to be cleaned for a plurality of bidirectional cleaning cycles, wherein oscillating the agitator forward comprises rotating the agitator in a first direction about the axis for a first time interval and oscillating the agitator backward comprises rotating the agitator in a second direction about the axis for a second time interval that is less than the first time interval, wherein the agitator is over-rotated or under-rotated with each oscillation of the agitator relative to a agitator starting position.

In still another aspect, a surface cleaning apparatus includes a brushless DC motor configured to rotate the agitator.

In another aspect, a surface cleaning apparatus includes a heat sink coupled to a motor casing of the brushless DC motor.

In another aspect of the disclosure, a method for cleaning a surface with a surface cleaning apparatus includes providing a surface cleaning apparatus that is operable in a standard cleaning mode and in a scrub mode, the surface cleaning apparatus including a suction inlet, a fluid dispenser, a bi-directionally rotatable agitator to agitate a surface to be cleaned, and a motor operably coupled to the agitator, and in response to detecting activation of the scrub mode, performing a plurality of bi-directional cleaning cycles and changing at least one of a fluid delivery parameter and a suction parameter to provide agitation, cleaning fluid, and suction at a surface to be cleaned, wherein each of the plurality of bi-directional cleaning cycles includes rotating the agitator in a first direction for at least a first plurality of revolutions followed by a first braking interval and counter-rotating the agitator in a second direction for at least a second plurality of revolutions followed by a second braking interval.

In yet another aspect, a method for scrubbing a surface to be cleaned includes detecting activation of a bidirectional scrub mode of a floor cleaner, the floor cleaner including a brushroll operably coupled to a brushless DC motor, and, in response to detecting activation of the bidirectional scrub mode, performing a plurality of bidirectional cleaning cycles of the brushroll, wherein each of the plurality of bidirectional cleaning cycles includes rotating the brushroll in a first direction for at least a first plurality of revolutions and counter-rotating the brushroll in a second direction for at least a second plurality of revolutions.

These and other features and advantages of the present disclosure will become apparent from the following description of particular embodiments, when viewed in accordance with the accompanying drawings and appended claims.

DETAILED DESCRIPTION

A surface cleaning apparatus having improved scrubbing is described below. The surface cleaning apparatus, also referred to herein as the "floor cleaner," has a cleaning system, or multiple cleaning systems, for cleaning a surface, including floor surfaces like carpet, rugs, wood, tile, and the like, or above-floor surfaces like countertops, furniture, and the like. The surface cleaning apparatus has at least one scrub mode in which the brushroll is oscillated back and forth. As will be appreciated from the description herein, the scrub mode has myriad use applications, but is generally used to break up stubborn stains, such as sticky spots, residues, heavily soiled areas, or other hard-to-clean spots, on the surface to be cleaned. As but one example, the scrub mode can oscillate the brushroll back and forth multiple times to remove a stubborn stain. At least some aspects of the floor cleaner provided herein function through the various elements thereof, as described below, to provides a seamless transition from floor cleaning to stain scrubbing without any extra steps or tools. Sticky, stuck-on stains are easily tackled by a surface cleaning apparatus provided with a scrub mode according to various aspects disclosed herein.

Furthermore, oscillating the brushroll can provide the additional benefit of fluffing up the material of the brushroll and/or reducing wear on the brushroll.

At least some aspects of the brushroll provided herein function through the various elements thereof, as described below, to enhance the scrub mode. The brushroll can have a scrub zone that can create more aggressive scrub action at or near the center of the brushroll. As such, certain features of the floor cleaner and/or brushroll may be considered functional but may also be implemented in different aesthetic configurations.

Figure 1:
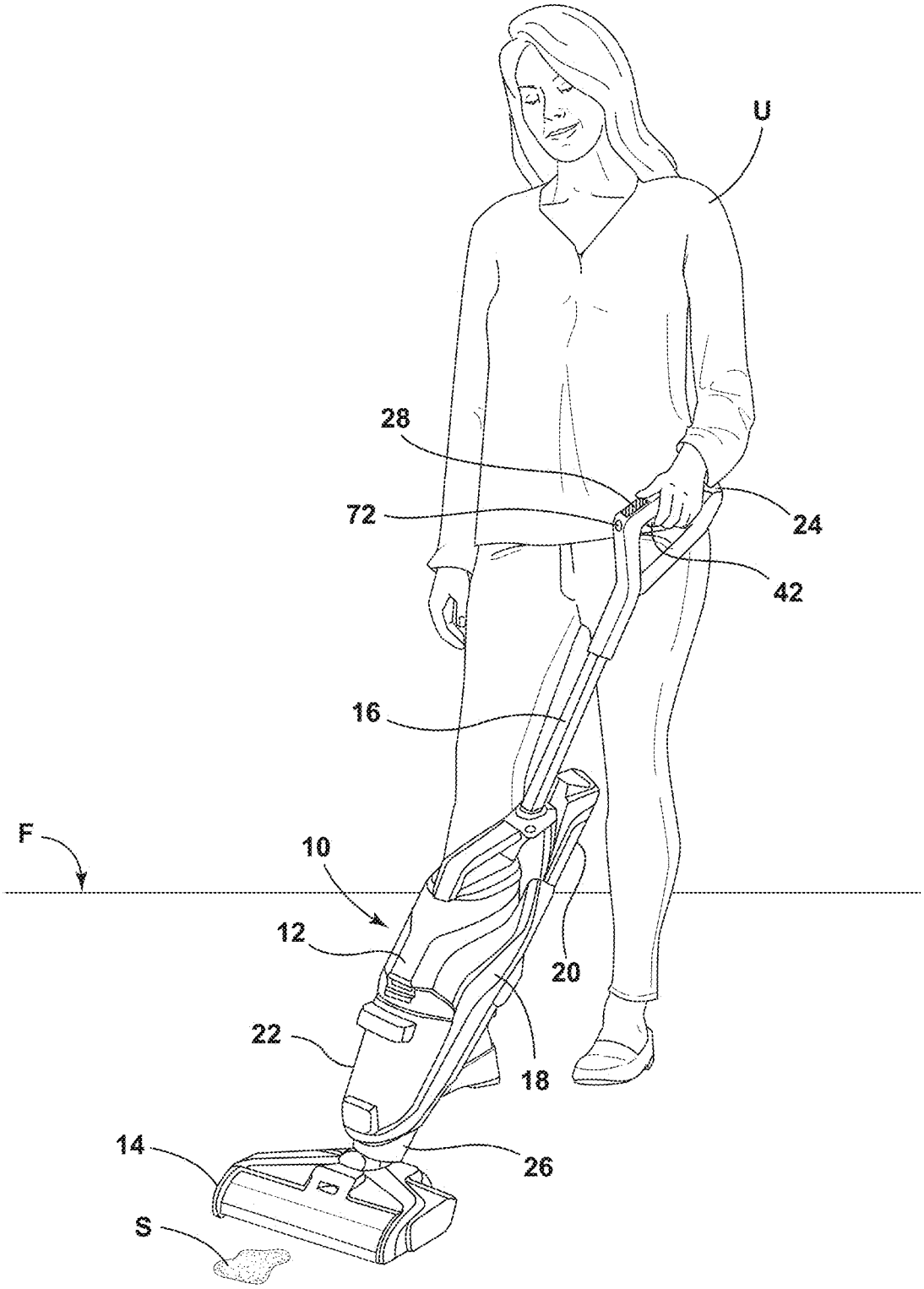
FIG. 1 is a perspective view of a surface cleaning apparatus, or floor cleaner, having a scrub mode according to one aspect of the disclosure and/or a brushroll according to another aspect of the disclosure, and shown being operated by a user and encountering a stubborn stain on a surface to be cleaned.
Figure 2:
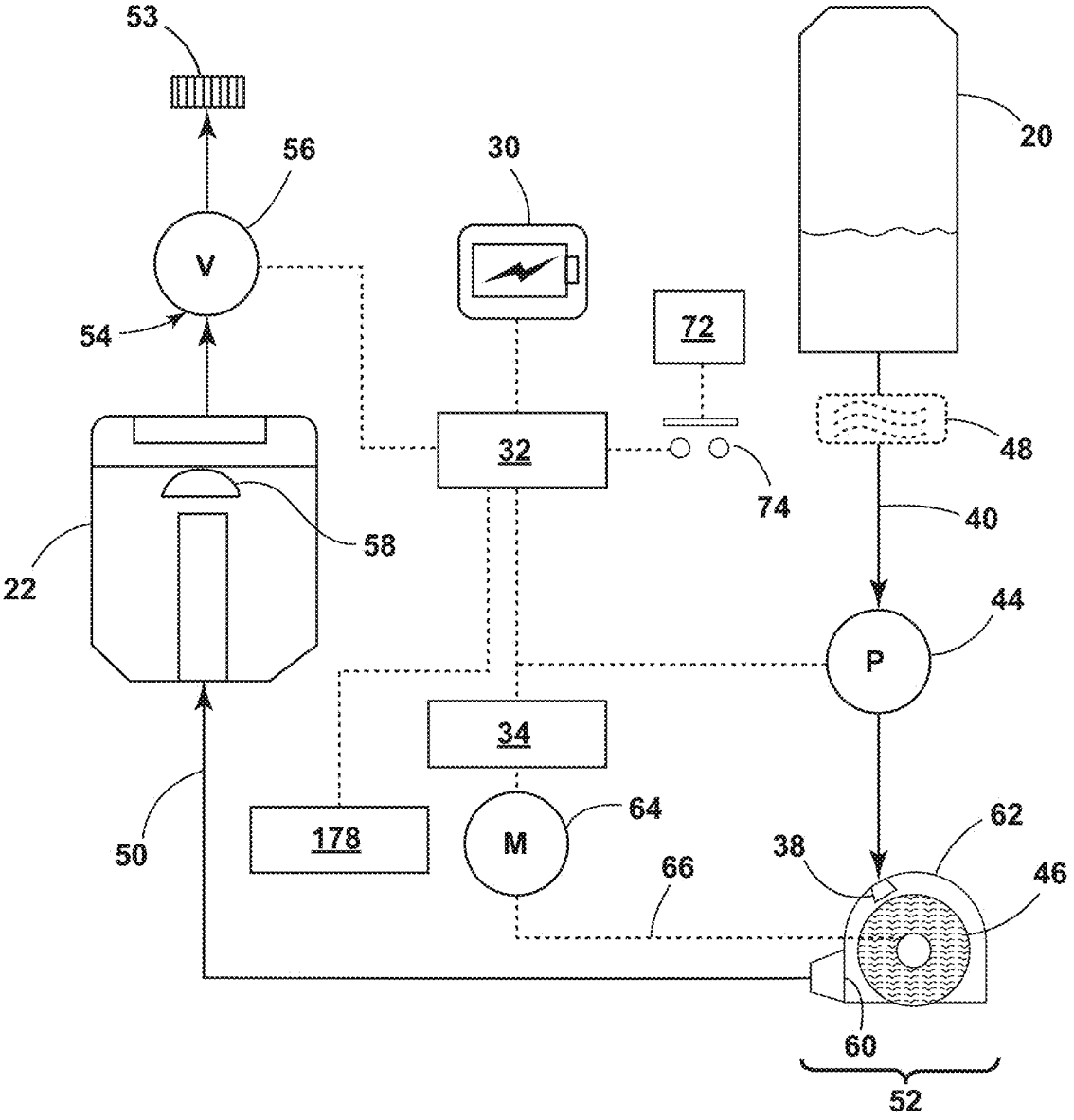
FIG. 2 is a schematic view of various functional systems of the floor cleaner of FIG. 1.

In an exemplary embodiment shown in FIGS. 1-2, wherein like numerals indicate corresponding parts throughout the several views, a surface cleaning apparatus is illustrated and generally designated at 10. As discussed in further detail below, the surface cleaning apparatus, also referred to herein as floor cleaner 10, is provided with various features and improvements, including a brushroll 46 and a scrub mode in which the brushroll 46 is rotated in alternating directions.

The floor cleaner 10 can be a wet/dry vacuum cleaner or wet/dry multi-surface cleaner that can be used to clean hard floor surfaces such as tile and hardwood and soft floor surfaces such as area rugs and carpet. The floor cleaner 10 can include at least one cleaning system, including a fluid delivery system and/or a recovery system. With both fluid delivery and recovery systems, the floor cleaner 10 can deliver cleaning fluid to the surface to be cleaned and can recover fluid and debris (which may include dirt, dust, stains, soil, hair, and other debris) from the surface to be cleaned.

The floor cleaner 10 includes an upright handle assembly or body 12 and a cleaning foot or base 14 mounted to or coupled with the upright body 12 and adapted for movement across a surface to be cleaned. The various cleaning systems and components thereof can be supported by either or both the base 14 and the upright body 12. The floor cleaner 10 can have a moveable joint assembly 26 that connects the base 14 to the upright body 12 for movement of the body 12 about at least one axis, or alternatively about at least two axes of rotation.

For purposes of description related to the figures, the terms "upper," "lower," "right," "left," "rear," "front," "vertical," "horizontal," "inner," "outer," and derivatives thereof shall relate to the disclosure as oriented in FIG. 1 from the perspective of a user U behind the floor cleaner 10, which defines the rear of the floor cleaner 10. However, it is to be understood that the disclosure may assume various alternative orientations, except where expressly specified to the contrary.

The upright body 12 can comprise a handle 16 and a frame 18. The frame 18 can comprise a main support section at least partially supporting a supply tank 20 and a recovery tank 22, and the frame 18 may further support additional components of the body 12. The floor cleaner 10 can include a fluid delivery or supply pathway, including and at least partially defined by the supply tank 20, for storing cleaning fluid, e.g. cleaning liquid, and delivering the cleaning fluid to the surface to be cleaned and a recovery pathway, including and at least partially defined by the recovery tank 22, for removing liquid and debris from the surface to be cleaned and storing the liquid and debris until emptied by the user.

The floor cleaner 10 can include at least one user interface ("UI") 28 through which a user can interact with the floor cleaner 10 to accomplish one or more functions, and such UI(s) can be disposed on the hand grip 24 as shown, and/or on the frame 18, and/or elsewhere on the floor cleaner 10.

The handle 16 can include a hand grip 24 that the user U can hold to maneuver the floor cleaner 10 during operation. Generally, the floor cleaner 10 is operated by moving the floor cleaner 10 back and forth over a surface to be cleaned in a series of cleaning strokes. The user U may initiate a cleaning stroke by pushing the floor cleaner 10 forwardly in a forward stroke or pulling the floor cleaner 10 rearwardly in a rearward stroke. At the end of a cleaning stroke, the floor cleaner 10 is moved in the opposite direction.

During operation, the floor cleaner 10 may encounter a stain S on a surface being cleaned F. The stain S may, for example, be a stubborn stain, such as a sticky spot, residue, heavily soiled area, or other hard-to-clean spots. Such a stain S may be difficult to remove with a standard cleaning mode of the floor cleaner 10, even with multiple passes or cleaning strokes over the stain S. As described below, the floor cleaner 10 is provided with a scrub mode in which the brushroll 46 is oscillated back and forth to clean the stain S. The scrub mode can work while the floor cleaner 10 is in a static (non-moving) position over the stain S, avoiding the need for making multiple passes or cleaning strokes to clean the stain S. Further, in some embodiments, the scrub mode includes dispensing cleaning fluid and/or applying suction. Accordingly, a pump 44 and/or a vacuum motor 56 may operate during at least a portion of the scrub mode. Yet further, in some embodiments, the scrub mode includes increased dwell time for cleaning fluid on the surface to be cleaned, such as by increasing fluid flow rate and/or decreasing suction level. Still further, in some embodiments, the brushroll 46 can comprise a configuration that enhances stain removal (see, for example, FIG. 16).

FIG. 2 is a schematic view of various functional systems of the floor cleaner 10. The delivery system includes at least one supply tank 20 configured to hold a cleaning fluid, at least one fluid dispenser 38 supplied with cleaning fluid from the supply tank 20, and a fluid supply path 40 from the supply tank 20 to the fluid dispenser 38.

The supply tank 20 can store cleaning fluid in liquid form. The cleaning fluid can comprise one or more of any suitable cleaning fluids, including, but not limited to, water, compositions, concentrated detergent, diluted detergent, other surface cleaning and/or treatment agents, and mixtures thereof. For example, the cleaning fluid can comprise water. In another example, the cleaning fluid can comprise a mixture of water and concentrated detergent.

It is noted that while the floor cleaner 10 described herein is configured to deliver a cleaning liquid, aspects of the disclosure may be applicable to surface cleaning apparatus that deliver steam. Thus, the term "cleaning fluid" may encompass liquid, steam, or both, unless otherwise noted.

The delivery system can include a flow controller for controlling the flow of fluid from the supply tank 20 to the fluid dispenser 38. In one configuration, the flow controller can comprise a pump 44, which pressurizes the supply path 40 and controls the delivery of cleaning fluid to the fluid dispenser 38. In one example, the pump 44 can be a centrifugal pump. In another example, the pump 44 can be a solenoid pump having a single, dual, or variable speed.

In another configuration of the supply pathway, the pump 44 can be eliminated and the flow control system can comprise a gravity-feed system having a valve fluidly coupled with an outlet of the supply tank 20, whereby when valve is open, cleaning fluid will flow under the force of gravity to the dispenser 38.

The dispenser 38 can comprise various structures, such as a nozzle, a spray tip, or a manifold, and can comprise at least one fluid outlet for dispensing cleaning fluid to the surface to be cleaned. The dispenser 38 can be positioned to deliver cleaning fluid directly to the surface to be cleaned, or indirectly by delivering cleaning fluid onto the brushroll 46. In one non-limiting example, the dispenser 38 delivers cleaning fluid onto the brushroll 46.

The release of cleaning fluid from the dispenser 38 can be controlled manually by the user, or automatically by selection of a cleaning mode. For example, the release of cleaning fluid from the dispenser 38 can be controlled via a trigger 42 on the hand grip 24, and/or via the UI 28, and/or automatically by a central controller 32, described in further detail below.

The delivery system can include other conduits, ducts, tubing, hoses, connectors, valves, etc. fluidly coupling the components of the delivery system together and providing the supply path 40.

Optionally, a heater 48 can be provided for heating the cleaning fluid prior to delivering the cleaning fluid to the surface to be cleaned. In one example, an in-line heater 48 can be located downstream of the supply tank 20, and upstream or downstream of the pump 44. Other types of heaters can also be used. In yet another example, the cleaning fluid can be heated using exhaust air from a motor cooling air path for a suction source of the recovery system. In yet another example, the cleaning fluid is unheated.

The recovery system can include a recovery path 50 through the floor cleaner 10 having a path inlet 52 and a path outlet 53, a suction source 54 including a vacuum motor 56 in fluid communication with the path inlet and configured to generate a working stream through a recovery path 50, and the recovery tank 22 for separating and collecting liquid and debris from a working stream for later disposal. A separator 58 can be formed in a portion of the recovery tank 22 for separating liquid and entrained debris from the working stream.

In one embodiment, the path inlet 52 is disposed on the base 14 and can be defined by a suction inlet port 60 and/or a brush chamber 62 disposed on the cleaning head or base 14. One or both of the suction inlet port 60 and the brush chamber 62 can be formed at least in part by a suction nozzle, a brush cover, or a combination thereof.

The recovery system can include other conduits, ducts, tubing, hoses, connectors, etc. fluidly coupling the components of the recovery system together and providing the recovery path 50.

As disclosed above, the floor cleaner 10 can include a rotatable brushroll 46. In one non-limiting example, the suction inlet port 60 is positioned in close proximity to the brushroll 46 to collect liquid and debris directly from the brushroll 46. Other embodiments of the floor cleaner 10 can include more than one rotating brushroll 46, such as dual brushrolls 46, one or more vertically-rotating brushrolls, one or more rotating cleaning pads, or one or more other rotating agitators.

At least a portion of the brushroll 46 extends from the base 14 to agitate the surface to be cleaned. For example, the brushroll 46 can include an agitation material extending into contact with the surface to be cleaned. In one embodiment, the agitation material is microfiber. The microfiber can be constructed of polyester, polyamides, or a conjugation of materials including polypropylene, or any other suitable material known in the art from which to construct microfiber, also referred to herein as nap, although it is understood that the brushroll 46 may have a nap construction of fibrous material other than microfiber. The microfiber, alternatively referred to herein as microfiber material, can include fibers supported on a backing, with the backing applied to a dowel of the brushroll 46.

In another embodiment, the brushroll 46 can be a hybrid brushroll, with agitation materials comprising a combination of microfiber and bristles for agitation. Other embodiments of brushroll 46 are possible, such as a bristle brushroll suitable for use on soft surfaces and having bristles and no microfiber. Yet other agitation materials include foam and textile fibers. Optionally, the apparatus can be provided with multiple, interchangeable brushrolls 46, which allows for the selection of a brushroll depending on the cleaning task to be performed or depending on the floor type of be cleaned.

A drive assembly including a brushroll motor 64 can drive the brushroll 46. A drive transmission 66 operably connects the motor 64 with the brushroll 46 to rotate the brushroll 46, and can comprise one or more belts, pulleys, gears (for example a planetary drive or a cycloidal drive), or the like for transmitting rotational motion of the motor 64 to the brushroll 46. The brushroll motor 64 can be disposed in the base 14, preferably behind or rearward of the brushroll 46 to accommodate the brushroll 46 closer to a leading edge of the base 14. Alternatively, the brushroll 46 can comprise a motor-in-dowel configuration, with the brushroll motor 64 and drive transmission 66 incorporated into a dowel of the brushroll 46. The brushroll motor 64 can be a brushless DC motor. Alternatively, a brushed DC or AC motor can be used.

In the illustrated embodiment, the brushroll motor 64 comprises a brushless DC motor that is responsive to commands from a motor controller 34. The motor controller 34 is optionally integrated into the brushless DC motor 64, which is self-contained within a cylindrical jacket of aluminum, copper, or other thermally-conductive material. In other embodiments, the motor controller 34 is external to the brushroll motor 64, optionally being integrated into the central controller 32. As shown in FIG. 2 however, the motor controller 34 is electrically coupled to the central controller 32, which provides an electrical signal to the motor controller 34 in response to activation of the scrub mode and the standard cleaning mode(s) by the user. The motor controller 34, in turn, provides electrical signals to the brushroll motor 64 to regulate its speed and direction in conformance with the selected operating mode.

In one embodiment, the central controller 32 provides a speed control signal and a directional control signal to the motor controller 34. The speed control signal includes a pulse width modulated (PWM) control signal having a duty cycle that is proportional to the desired motor speed. The directional control signal can also include a PWM control signal in which a first duty cycle (e.g., 25%) represents forward rotation and a second duty cycle (e.g., 50%) represents reverse rotation. In this example, the central controller 32 provides two separate PWM control signals to the motor controller 34: a first PWM control signal to control motor speed, and a second PWM control signal to control motor direction. Alternatively, the directional control signal can be high or low depending on the desired motor direction. For example, a high directional control signal (e.g., 5V) can indicate clockwise-rotation is desired, while a low directional control signal (e.g., 0V) can indicate counter-clockwise rotation is desired.

The motor controller 34 converts these control inputs (speed and direction) into suitable control signals for the brushroll motor 64. In the case of a brushless DC (BLDC) motor, the motor controller 34 increases the commutation frequency in proportion to the increased duty cycle of the PWM control signal and/or increases the PWM voltage applied to each stator winding. Reversing the direction of the motor is accomplished by altering the order in which the motor's windings are energized. Because BLDC motors are driven by electronically controlled commutation, the motor direction is reversed by reversing the order of the commutation sequence (i.e., changing the sequence in which the stator windings are energized). In one example, a three-phase BLDC motor includes a stator having three windings and a rotor having a permanent magnet. To spin the rotor in a first (e.g., clockwise) direction, the windings are energized sequentially (e.g., winding A, winding B, and winding C). To spin the rotor in a second (e.g., counter-clockwise) direction, the windings are energized sequentially, but in the reverse order (e.g., winding C, winding B, and winding A). Other control methods to spin the rotor in a desired direction are possible.

In these and other embodiments, the BLDC motor can comprise a sensored-BLDC motor. The sensored-BLDC motor can include Hall sensors to detect the rotor's magnetic field and provide real-time feedback to the motor controller 34 regarding the rotor's position. The motor controller 34 uses this information to adjust the timing of the PWM currents to the stator windings and/or the sequence of energizing the windings. Alternatively, the BLDC motor can comprise a sensor-less BLDC motor, in which the motor controller 34 estimates the position of the rotor based on a back-EMF generated voltage.

To minimize mechanical wear on the brushroll motor 64, and to guard against large current spikes, the brushroll motor 64 is allowed to come to rest before reversing directions. In one embodiment, the motor controller 34 provides a predetermined braking interval when changing directions. The predetermined braking interval can be selected to ensure the brushroll motor 64 freewheels to a stop due to friction, including but not limited to friction of the brushroll 46 against the surface to be cleaned, thus minimizing electrical, mechanical, and thermal stresses on the brushroll motor 64. The predetermined braking interval is optionally at least 10 ms, further optionally between 10 ms and 200 ms, yet further optionally 10 ms and 40 ms, still further optionally about 15 ms. In other embodiments, the motor controller 34 actively brakes the brushroll motor 64 (rather than passively braking), optionally by generating a reverse torque or by shorting some of the stator windings.

As noted above and as shown in FIG. 2, the floor cleaner 10 includes a drive transmission 66 between the brushroll motor 64 and the brushroll 46. The drive transmission 66 can include a gear reduction for increasing the torque of the brushroll 46. For example, the drive transmission 66 can include a planetary drive or a cycloidal drive with a gear reduction, such that the brushroll motor 64 can operate more efficiently, while the brushroll 46 receives the necessary torque for removing difficult stains. The gear reduction can be selected based on the particular application. Example gearing ratios include between 2:1 and 10:1, optionally about 7:1. For example, if a 7:1 gearing ratio is selected, the drive transmission 66 converts a given motor speed (e.g., 7700 rpm) to desired brushroll speed (e.g., 1100 rpm). Other gear reductions can be used as desired, while still other embodiments omit the gear reduction, providing a 1:1 gearing ratio.

Electrical components of the floor cleaner 10, including the pump 44, vacuum motor 56, brushroll motor 64, or any combination thereof, are electrically coupled to a power source, which can comprise a battery 30 for cordless operation, preferably a rechargeable battery. In one example, the rechargeable battery 30 is a lithium-ion battery. The rechargeable battery can be recharged in place on the floor cleaner 10 or can be removed from the floor cleaner 10 for recharging. With a rechargeable battery, an appropriate charger can be provided with the floor cleaner 10. For example, a tray (not shown) can store the floor cleaner 10 and recharge the battery 30 when not in use. In another exemplary configuration, the battery 30 can comprise a user replaceable battery. In yet another embodiment, the power source can comprise power cord adapted to be plugged into a household electrical outlet for corded operation.

As noted above, the floor cleaner 10 includes a central controller 32 operably coupled with the various systems and components of the floor cleaner 10. In one embodiment the central controller 32 can comprise a printed circuit board ("PCB"). As used herein, unless otherwise noted, the term "PCB" includes a printed circuit board having a plurality of electrical and electronic components that provide operational control to the floor cleaner 10. The PCB includes, for example, a processing unit (e.g., a microprocessor, a microcontroller, or another suitable programmable device) and a memory (e.g., a read-only memory ("ROM"), a random-access memory ("RAM"), an electrically erasable programmable read-only memory ("EEPROM"), a flash memory, or another suitable magnetic, optical, physical, or electronic memory device). The processing unit is connected to the memory and executes instructions (e.g., software) that is capable of being stored in the RAM (e.g., during execution), the ROM (e.g., on a generally permanent basis), or another non-transitory computer readable medium such as another memory or a disc. Additionally or alternatively, the memory is included in the processing unit (e.g., as part of a microcontroller). Software stored in memory includes, for example, firmware, program data, one or more program modules, and other executable instructions. The processing unit is configured to retrieve from memory and execute, among other things, instructions related to the control processes and methods described herein. The PCB can also include, among other things, a plurality of additional passive and active components such as resistors, capacitors, inductors, integrated circuits, and amplifiers. These components are arranged and connected to provide a plurality of electrical functions to the PCB including, among other things, signal conditioning or voltage regulation. For descriptive purposes, the PCB and the electrical components populated on the PCB may be referred to as central controller 32.

Referring to FIGS. 1-2, the floor cleaner 10 has at least one standard cleaning mode, and which may be executed for cleaning the entirety of or a majority of the floor surface F, and at least one scrub mode, which may be executed by the user for cleaning a stain S on a surface being cleaned F. The standard cleaning and scrub modes can have associated operating parameters for the brushroll motor 64, the pump 44, and/or the vacuum motor 56, and at least one of the operating parameters is adjusted in the scrub mode. The central controller 32 can comprise a memory storing instructions that, when executed by the central controller 32, automatically effectuates the standard cleaning mode or the scrub mode, examples of which are described below. As such, operation of the brushroll motor 64, the pump 44, or the vacuum motor 56, or any combination thereof, can be mode-dependent, such that rotation of the brushroll 46, release of cleaning fluid from the dispenser 38, or suction at the suction inlet port 60, or any combination thereof, is controlled automatically.

In some embodiments, the central controller 32 can store and execute more than one standard cleaning mode and/or more than one scrub mode. For example, the floor cleaner 10 can have multiple standard cleaning modes, and these standard cleaning modes may include a hard floor wet mode and an area rug wet mode, each of which has associated operating parameters for the pump 44, vacuum motor 56, and/or brushroll motor 64. The floor cleaner 10 can further have a dry vacuuming mode in which the cleaning fluid is not dispensed. Further examples of standard cleaning modes and scrub modes are disclosed below.

Figure 3:
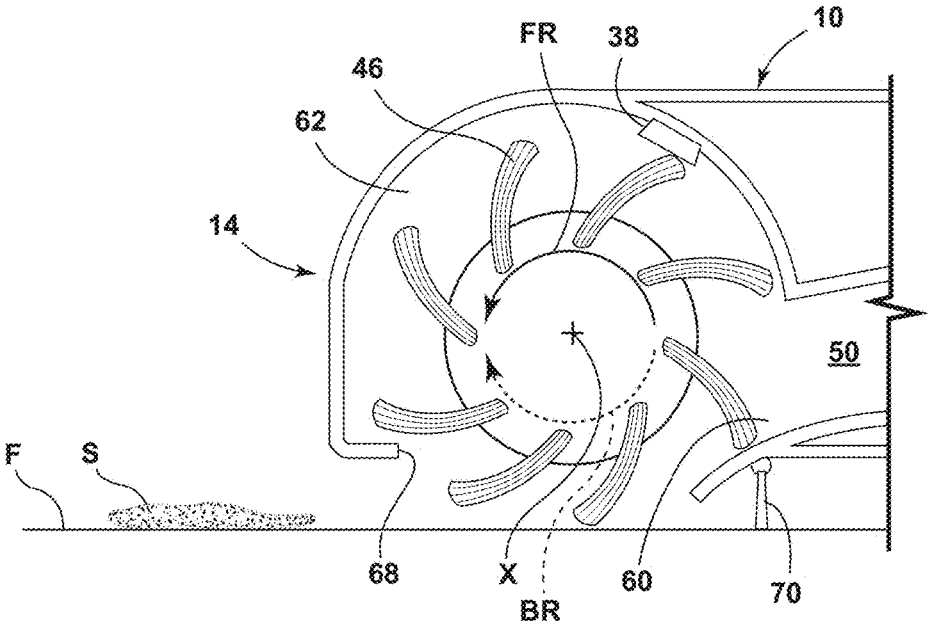
FIG. 3 is a close-up, sectional view through a base of the floor cleaner of FIG. 1, showing a brushroll, a brush chamber, and a portion of a recovery path of the floor cleaner.

Referring to FIG. 3, the brushroll 46 can be received in the brush chamber 62 and disposed at least partially within or adjacent to the recovery path 50. In the present embodiment, the suction inlet port 60 is configured to extract liquid and debris from the brushroll 46. With the brush chamber 62 being open to the surface to be cleaned, some liquid and debris may be extracted from the surface to be cleaned as well. As such, the brush chamber 62 can form a portion of the recovery path 50, with the suction inlet port 60 being open to the chamber 62.

It is noted that, in another embodiment, the brushroll 46 can be disposed outside the recovery path 50, such as by being disposed under and/or rearward of a suction nozzle defining the suction inlet port 60, such that the recovery system does not apply suction directly to the brushroll 46. In this embodiment, the suction nozzle defining the suction inlet port 60 can be disposed in front of and/or above the brush chamber 62, such that the suction inlet port 60 is positioned to recover liquid and debris directly from the floor surface. In this embodiment, the floor cleaner 10 may be, but is not limited to, an extraction cleaner configured to deep clean a carpeted surface.

The brushroll 46 is rotatable about an axis X, which may be a substantially horizontal axis X (e.g., normal to the page in the orientation of FIG. 3). A substantially horizontal axis X may be preferred for cleaning floor surfaces, as the brushroll 46 is substantially parallel to the floor surface over which the floor cleaner 10 moves. By "substantially," the axis of the brushroll 46 can deviate from horizontal by up to 5 degrees, alternatively up to 10 degrees.

The brushroll 46 can rotate forwardly in a first or forward direction FR about the axis X and rearwardly in a second or backward direction BR about the axis X. The brushroll motor 64 and/or drive transmission 66 (FIG. 2) are configured to rotate the brushroll 46 in the forward direction FR or in the backward direction BR. As described in further detail below, in some embodiments, rotation of the brushroll 46 forward, backward, or in combination of forward and backward, can be mode-dependent, such that the rotational direction of the brushroll 46 is controlled automatically. In other words, depending on a selected cleaning mode of the floor cleaner 10, the brushroll motor 64 may rotate the brushroll 46 forward, backward, or may not be activated, such that the brushroll 46 does not rotate.

In some embodiments, the base 14 has at least one interference wiper 68 configured to interface with a portion of the brushroll 46. In the embodiment shown in FIG. 3, an interference wiper 68 mounted at a forward portion of the brush chamber 62 and is configured to interface with a leading portion of the brushroll 46, as defined by the direction of forward rotation FR of the brushroll 46. The interference wiper 68 may be below the dispenser 38, such that a wetted portion brushroll 46 rotates past the interference wiper 68 during forward rotation FR, which can scrape any excess liquid off the brushroll 46 and/or evenly spread or distribute cleaning fluid across the width of the brushroll prior to reaching the surface to be cleaned. The wiper 68 can be sufficiently rigid, i.e., sufficiently stiff and non-flexible, so the wiper 68 does not yield or flex by engagement with the brushroll 46. Other locations for the wiper 68 in relation to the brushroll 46, where the wiper 68 is configured to interface with a portion of the brushroll 46, are possible. For example, the wiper 68 can be located at a rear portion of the brush chamber 62, between the suction inlet port 60 and the dispenser 38. In yet other embodiments, the floor cleaner 10 does not have any interference wiper in engagement with the brushroll 46.

In some embodiments, a squeegee 70 is mounted behind the brushroll 46 and the brush chamber 62 and is configured to contact the surface F as the base 14 moves across the surface F. The squeegee 70 wipes residual liquid from the surface to be cleaned so that it can be drawn into the recovery pathway via the suction inlet port 60, thereby leaving a moisture and streak-free finish on the surface to be cleaned. The squeegee 70 can be sufficiently pliant, i.e., sufficiently flexible or resilient, in order to bend readily according to the contour of the surface to be cleaned yet remain undeformed by normal use of the floor cleaner 10. Other locations for the squeegee 70 in relation to the brushroll 46 are possible. In yet other embodiments, the floor cleaner 10 does not comprise squeegee 70.

Figure 13:
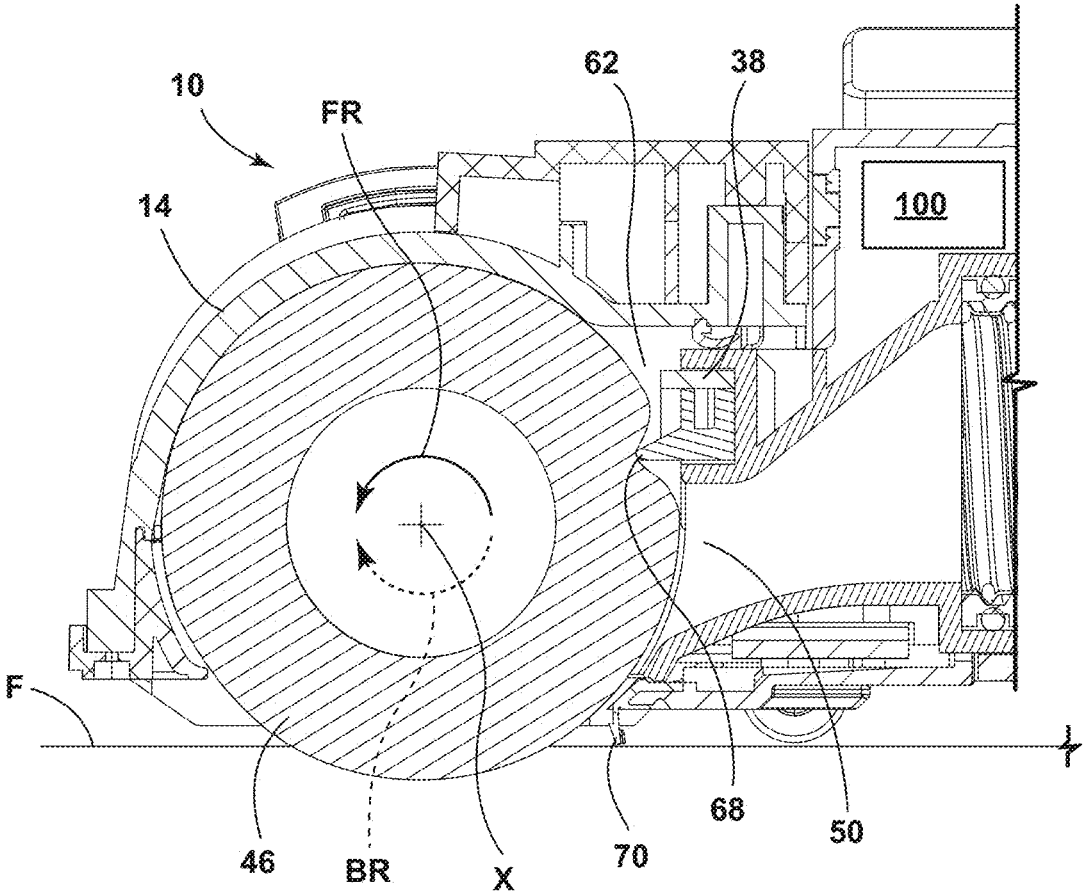
FIG. 13 is a sectional view of the floor cleaner base having a brushroll height setter according to another aspect of the disclosure.

In another embodiment of the base 14, an example of which is shown in FIG. 13, a suction guard 98 is disposed between the suction inlet port 60 and the outlet of the fluid dispenser 38 to prevent cleaning fluid dispensed from the fluid dispenser 38 from getting suctioned into the recovery pathway immediately and/or before wetting the brushroll 46. Without the suction guard 98, cleaning fluid may be pulled directly into the recovery pathway and may bypass the brushroll 46 entirely. The suction guard 98 partially projects into the nap of the microfiber brushroll 46 (or other agitation material in the case of a non-microfiber brushroll) and prevents cleaning fluid from being sucked into the suction inlet port 60 immediately after being distributed from the fluid dispenser 38. The suction guard 98 does not seal against the brushroll 46 and working air can still move through the porous nap (or other agitation material) of the brushroll 46 so that at least some suction is present at a forwardmost portion of the of the brush chamber 62, e.g., between the brushroll 46 and its cover. In the present embodiment, the suction guard 98 is integrated with the fluid dispenser 38, however in other embodiments, the suction guard 98 is not integrated with, and may be provided separately from, the fluid dispenser 38. The suction guard 98 can be rigid, i.e. stiff, and non-flexible, so the suction guard 98 does not yield or flex by engagement with the brushroll 46.

No interference wiper is provided in the embodiment of FIG. 13, although in another embodiment, an interference wiper like wiper 68 (FIG. 3) is included in addition to the suction guard 98.

The standard cleaning mode includes rotating the brushroll 46 forward about the axis X, e.g., continuously rotating the brushroll 46 in the first direction FR about the axis X. Further, in some embodiments, the standard cleaning mode includes dispensing cleaning fluid and/or applying suction during rotation of the brushroll 46. Still further, in some embodiments, the standard cleaning mode provides a first or standard dwell time for cleaning fluid on the surface to be cleaned. The standard dwell time may be an average dwell time of cleaning fluid during the standard cleaning mode, as some variation of dwell time may occur throughout the standard cleaning mode since dwell time of cleaning fluid on the surface to be cleaned is dependent on fluid flow rate and suction level, and the fluid flow rate and/or suction level may vary during the standard cleaning mode.

Referring to FIG. 1, the user U can operate the floor cleaner 10 in the standard cleaning mode to clean the floor surface F. During operation, the floor cleaner 10 may encounter a stain S on a surface being cleaned F. Such a stain S may be difficult to remove using with the standard cleaning mode of the floor cleaner 10, even with multiple passes over the stain S. According to one aspect of the disclosure, when such a stain S is encountered, a scrub mode can be executed to remove the stain S. While not strictly required, the scrub mode can work while the floor cleaner 10 is in a static (non-moving) position over the stain S, avoiding the need for the user U to make multiple passes or cleaning strokes to clean the stain S. However, if a user U continues cleaning strokes during scrub mode, the number of strokes and time duration to remove the stain S will be reduced compared to standard cleaning mode.

Figure 4:
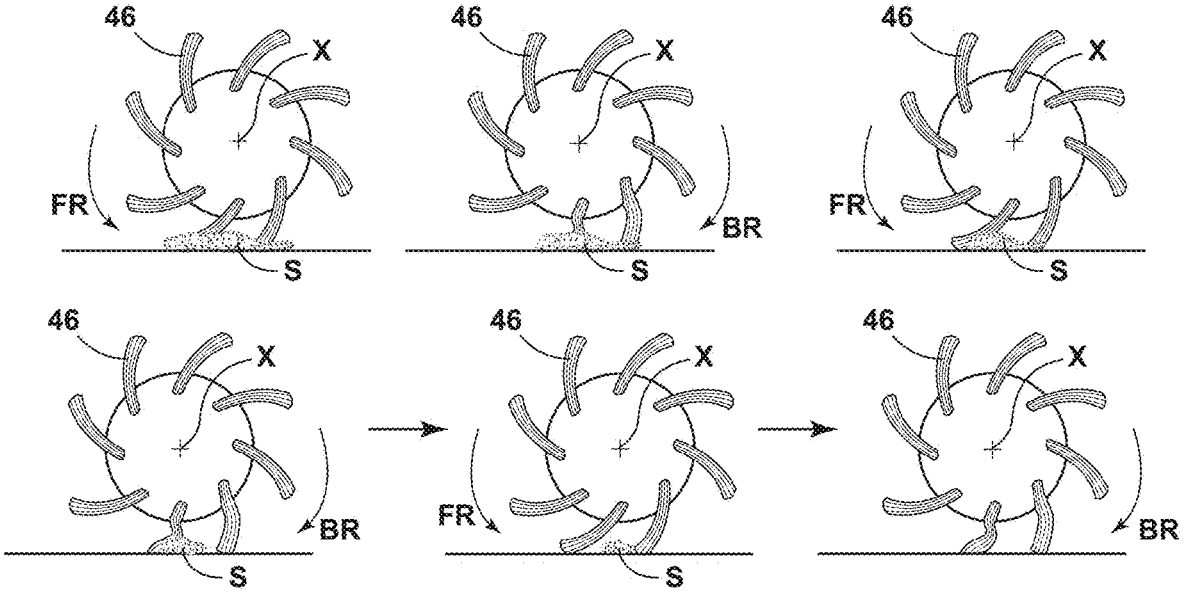
FIG. 4 is a schematic view of the scrub mode according to an exemplary embodiment of the disclosure, depicting oscillation of the brushroll to remove a stubborn stain on a surface to be cleaned.

FIG. 4 is a schematic view of the scrub mode, which includes oscillating the brushroll 46 forward and backwards about the axis X to scrub a surface to be cleaned to break up a stubborn stain S on the surface to be cleaned. Oscillating the brushroll 46 includes repeatedly rotating the brushroll 46 in the first direction FR about the axis X and in the second direction BR about the axis X. The brushroll is oscillated by automatically switching the rotational direction, i.e., without requiring a user action or user input. Further, in some embodiments, the scrub mode includes dispensing cleaning fluid and/or applying suction during oscillation of the brushroll 46.

In one aspect of the disclosure, oscillating the brushroll 46 can comprise automatically switching the rotational direction of the brushroll 46 at least every 0.5 seconds or less for the duration of the scrub mode. For example, the brushroll can switch direction at intervals of about 100 to 500 milliseconds. The duration of the scrub mode can be about 30 seconds to 5 minutes, alternatively about 45 seconds to 3 minutes, alternatively about 45 to 60 seconds.

The stain S can be detected by the user U (FIG. 1), such as by the user U observing the stain S on a surface being cleaned F. Alternatively, or in addition, the stain S can be detected by the floor cleaner 10. The scrub mode, once executed, can run for a predetermined time or a user-determined time. In another example, input from a sensor and/or the central controller 32 (FIG. 2) can determine the run time for the scrub mode.

Referring to FIG. 1, the floor cleaner 10 can comprise an input control 72 for selectively executing the scrub mode during operation of the floor cleaner 10. The input control shown herein as a scrub mode button 72 can be disposed anywhere on the floor cleaner 10 and may preferably be disposed where it is easily accessible by the user U, for example on the hand grip 24 and/or as part of the user interface 28. Other input controls for the scrub mode may be used instead of a button, such as, but not limited to, a trigger on the hand grip 24, a button, on the frame 18, or a foot pedal on the base 14.

The standard cleaning mode can be a default mode in which the floor cleaner 10 operates when turned on or can be selected using a button on the user interface 28 or elsewhere on the floor cleaner 10 that is separate from the scrub mode button 72. Alternatively, the cleaning mode (standard or scrub) can be selected by cycling though the modes using button 72.

Referring to FIG. 2, in one aspect of the disclosure, the floor cleaner 10 can comprise a switch 74 that is operated by the scrub mode button 72 for selectively executing the scrub mode. The switch 74 may be a momentary switch that is closed only as long as the user depresses the scrub mode button 72, e.g., the user presses and holds the button 72 for the duration of the scrub mode. In other words, when the scrub mode button 72 is pressed, the scrub mode is executed until the button 72 is released. In this manner, the length of time the scrub mode runs is determined by the user. Upon release of the scrub mode button 72, the scrub mode ends and the floor cleaner 10 can automatically revert to the previous cleaning mode, e.g., the standard cleaning mode, and the operating parameters can automatically revert to the standard levels for the dry or wet mode. Alternatively, in place of a momentary switch 74, pressing the button 72 can execute a scrub mode having predetermined cycle time.

Figure 5:
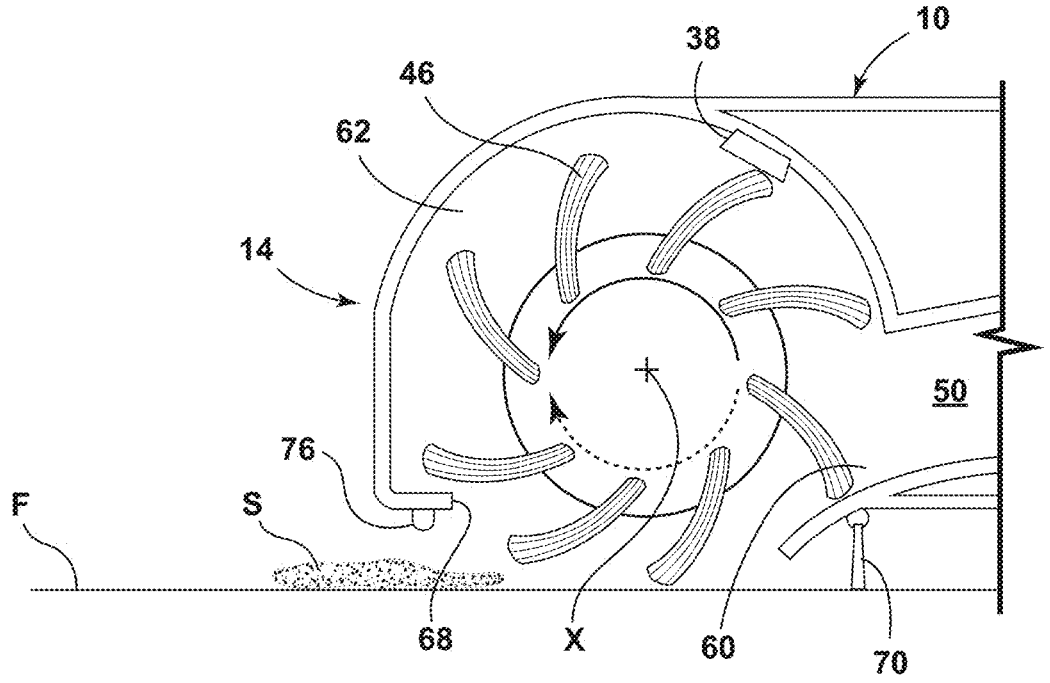
FIG. 5 is a close-up, sectional view through a base of a floor cleaner having a stain sensor according to an aspect of the disclosure.
Figure 6:
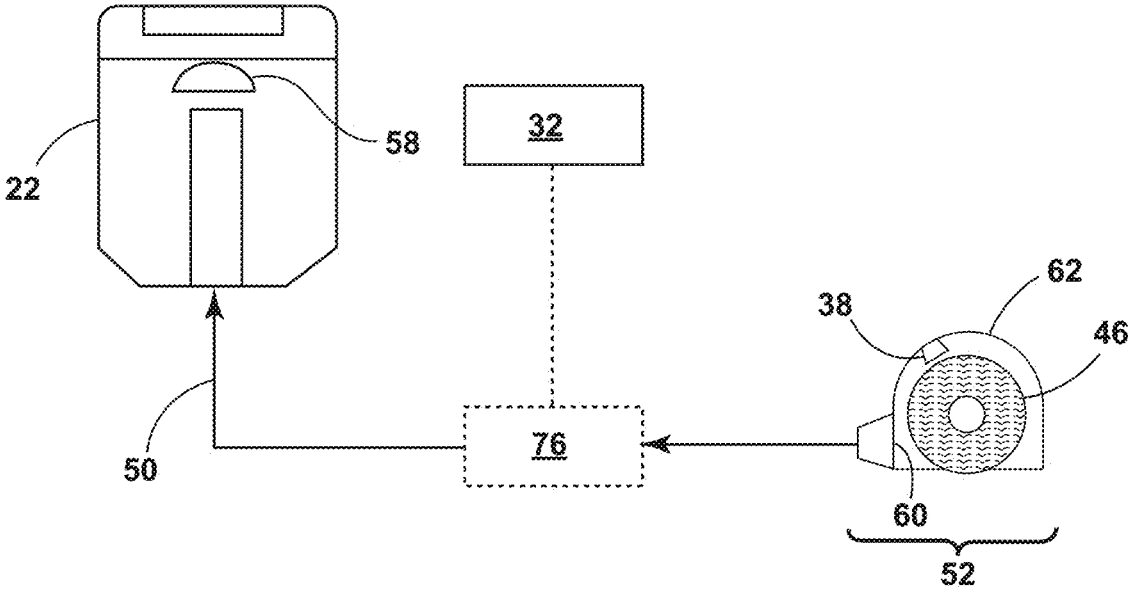
FIG. 6 is a schematic view of a recovery system of a floor cleaner having a stain sensor according to an aspect of the disclosure.

In FIG. 5-6, in one aspect of the disclosure, the floor cleaner 10 can include a stain sensor 76 configured to sense (directly or by inference) a stain on the surface to be cleaned F. Input from the sensor 76, which can be provided to the central controller 32, can be used to automatically execute the scrub mode, to provide a user notification recommending that the scrub mode be run, and/or to determine a run time for the scrub mode. For example, the scrub mode can be executed automatically by sensing the stain S on the floor F (e.g., using a light-sensitive stain sensor or a wet mess sensor on the base 14 as shown in FIG. 5) or by sensing increased dirtiness in recovered fluid (e.g., using a turbidity sensor or infrared stain sensor in the recovery path 50, including, but not limited to, at the path inlet 52, in or adjacent to the recovery tank 22, or in the path 50 between the inlet 52 and tank 22 as shown in FIG. 6). Some non-limiting locations for the stain sensor 76 are shown in FIGS. 5 and 6. In some embodiments, multiple stain sensors 76 can be provided for sensing different types of stains.

Figure 7:
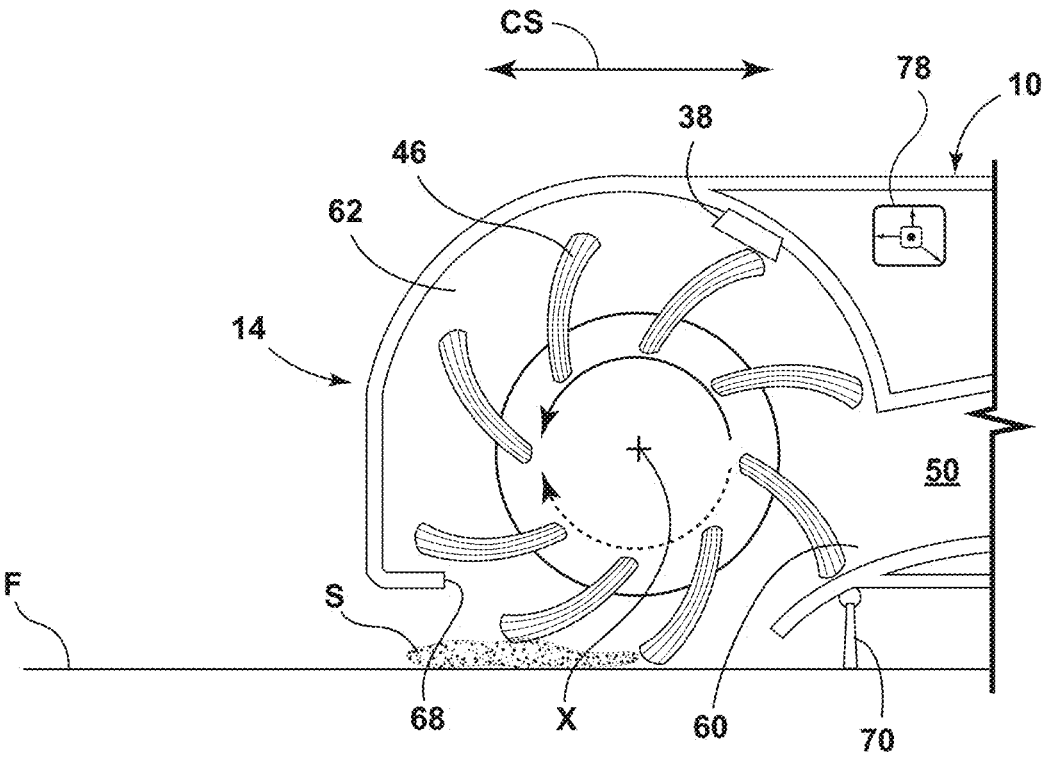
FIG. 7 is a close-up, sectional view through a base of a floor cleaner having a scrub action motion sensor according to an aspect of the disclosure.
Figure 8:
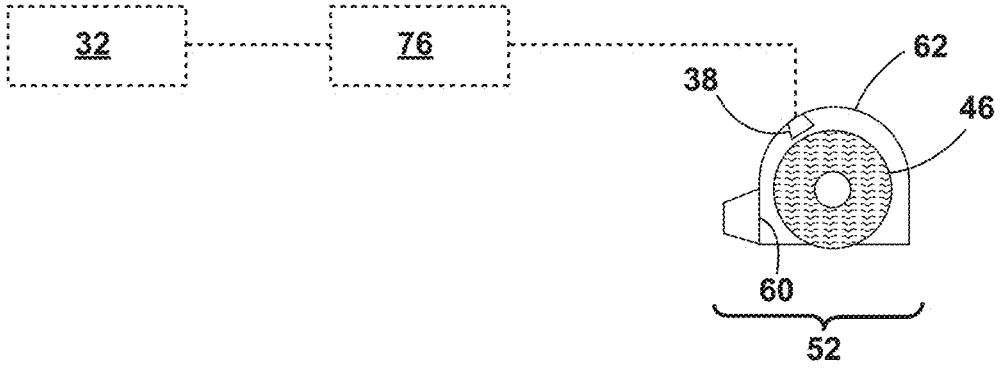
FIG. 8 is a schematic view of a control system of a floor cleaner having a scrub action motion sensor according to an aspect of the disclosure.

In FIGS. 7-8, in one aspect of the disclosure, the floor cleaner 10 can include a scrub action motion sensor 78 configured to sense, by inference, a stain on the surface to be cleaned F by sensing a scrubbing action by the user. When a user U encounters a stain S, a natural tendency of the user U may be to change the pace of the floor cleaner. For example, users may move the floor cleaner 10 back and forth more rapidly, back and forth more slowly, and/or for shorter distances in a series of short cleaning strokes CS. That is, the speed of each cleaning stroke increases, decreases, and/or stroke length shortens. In one aspect of the present disclosure, the floor cleaner 10 can be configured to leverage this intuitive action to improve stain cleaning by automatically initiating the scrub mode when one or more cleaning strokes CS of a pace above a fast stroke threshold is detected, when one or more cleaning strokes CS of a pace below a slow stroke threshold is detected, when a stroke length at or above a stroke length threshold is detected, or any combination thereof. One example of a scrub action motion sensor 78 is an accelerometer, which can be located on the base 14 to detect pace and/or a wheel rotation sensor which can detect stroke length based on wheel rotation. In some embodiments, multiple motion sensors 78 can be provided for sensing a scrubbing motion by the user.

The scrub action thresholds can be predetermined or can vary. For example, the scrub action thresholds can be preset based on an average normal cleaning pace of 8 inches/second to 24 inches per second, and an average normal stroke length in the range of 12 to 36 inches. In such an example, the controller can automatically initiate the scrub mode when a stroke pace above 24 inches/second is detected, when a stroke pace below 8 inches/second is detected, when a stroke length of less than 12" is detected, or any combination thereof.

For a variable scrub action threshold, the scrub action thresholds can be determined based on a change in pace and/or stroke length over time. For example, based in input from the motion sensor 78, the controller can automatically initiate the scrub mode in response to a detected change in pace and/or stroke length vs. what the user has been averaging over time. For example, the controller can automatically initiate the scrub mode when a stroke pace that is at least 30% faster than an average stroke pace for the last 2 minutes of cleaning is detected, when a stroke pace that is at least 30% slower than an average stroke pace for the last 2 minutes of cleaning is detected, when a stroke length that is at least 30% shorter than an average stroke length for the last 2 minutes of cleaning is detected, or any combination thereof.

Input from the scrub action motion sensor 78, which can be provided to the central controller 32, can be used to automatically execute the scrub mode, to provide a user notification recommending that the scrub mode be run, and/or to determine a run time for the scrub mode. For example, the scrub mode can be executed automatically by a scrub action motion by the user U (e.g., using an accelerometer on the base 14 or elsewhere on the floor cleaner 10). The pace and/or stroke length may need to be at a threshold level for multiple cleaning strokes or for a certain period of time before scrub mode initiates. The scrub mode may automatically end, and in some embodiments standard cleaning automatically resumed, once one or more cleaning strokes of a pace and/or stroke length associated with standard cleaning is detected.

In another aspect of the disclosure, input from the scrub action motion sensor 78 can be used to control the pump 44 during the scrub mode, such as by dispensing cleaning fluid on forward cleaning strokes and not dispensing cleaning fluid on backward cleaning strokes.

The total duration of the scrub mode can be predetermined or can vary. For example, where the scrub mode is initiated based on pressing button 72, input from stain sensor 76, or input from scrub action motion sensor 78, the total duration of the scrub mode can be preset, and can be about 30 seconds to 5 minutes, alternatively about 45 seconds to 3 minutes, alternatively about 45 to 60 seconds. For a time-variable scrub mode, the duration of the scrub mode can be determined by the user (for example, by holding down button 72 in an embodiment where it operates a momentary switch) or based in input from stain sensor 76 or motion sensor 78.

Figure 10:
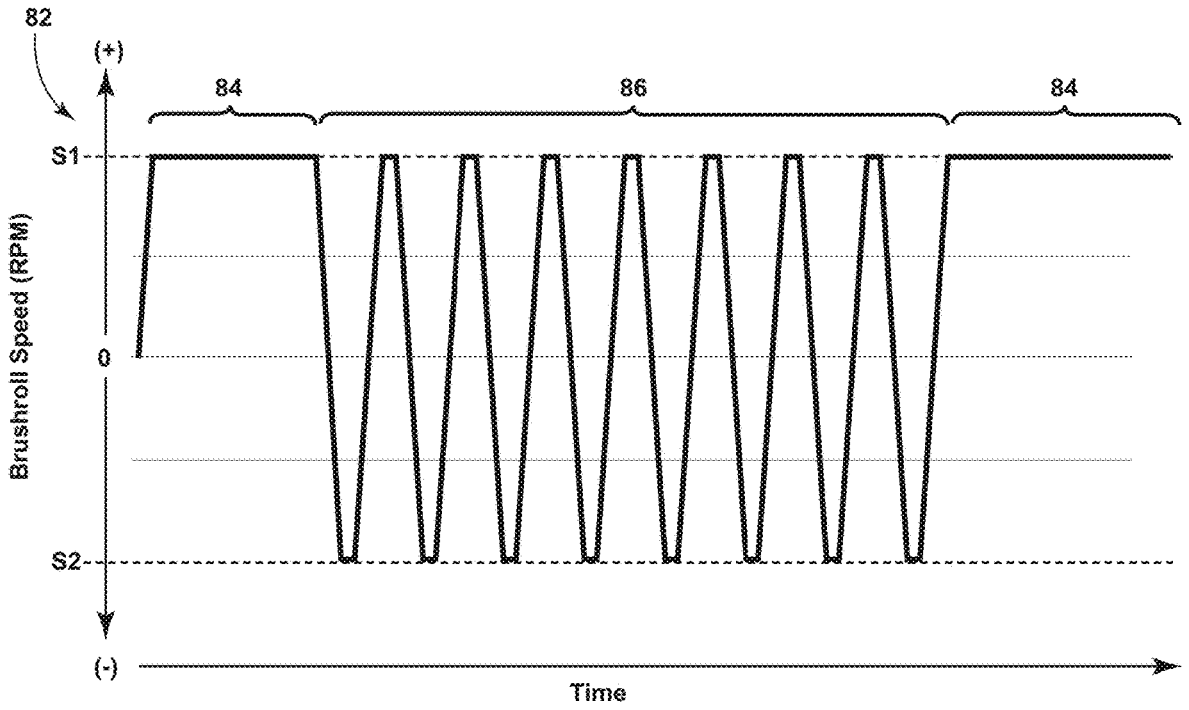
FIG. 10 is a graph depicting a scrub mode according to another exemplary embodiment of the disclosure.
Figure 11:
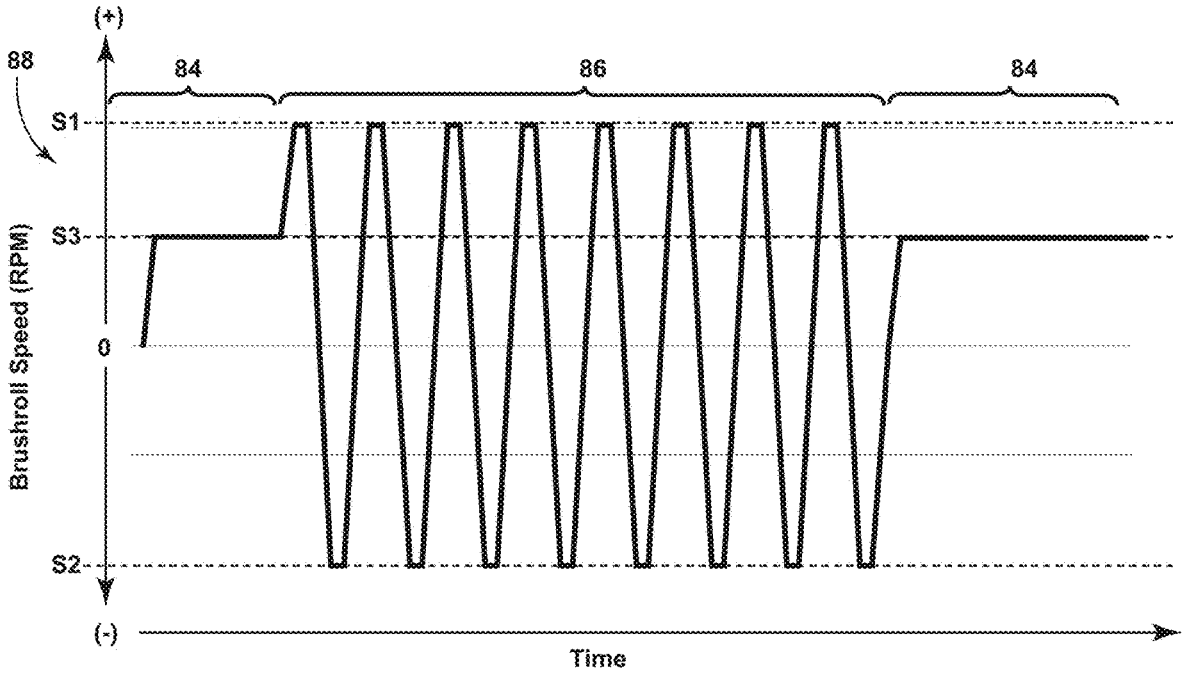
FIG. 11 is a graph depicting a scrub mode according to yet another exemplary embodiment of the disclosure.
Figure 12:
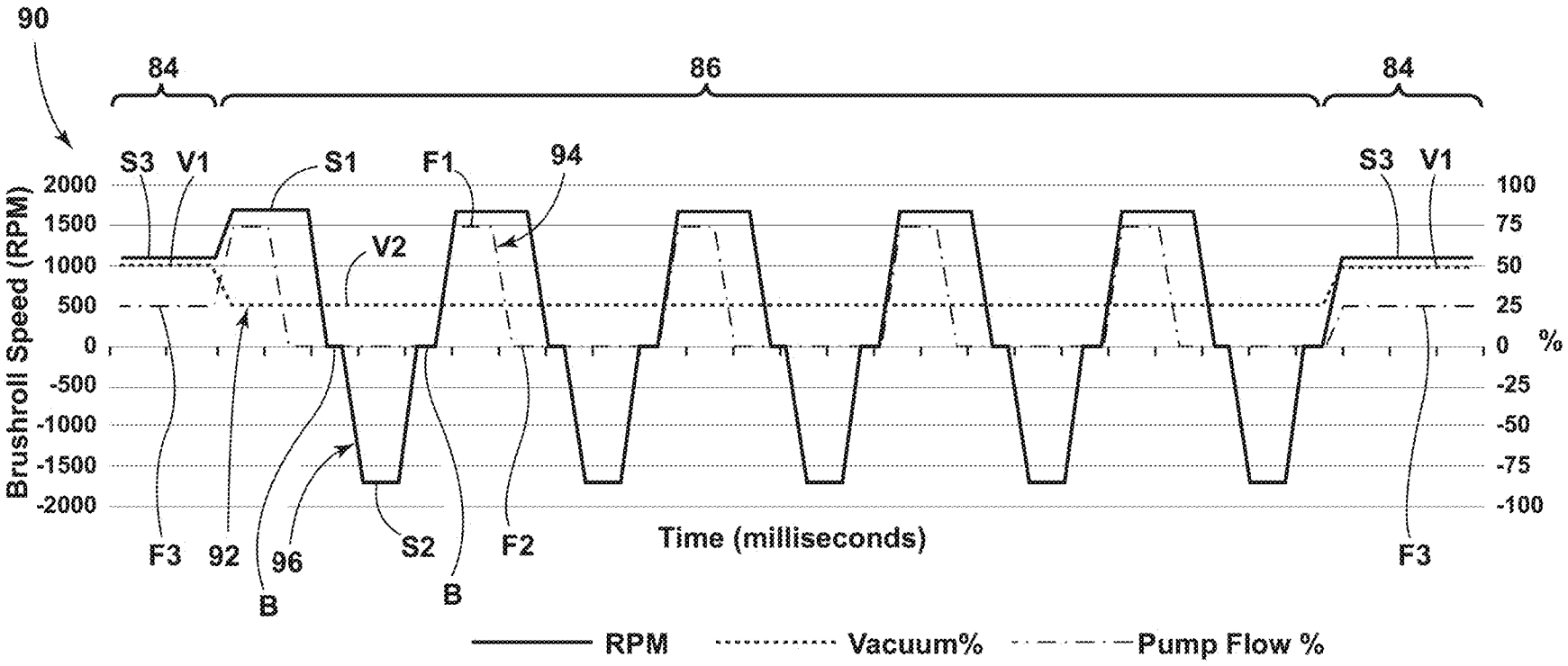
FIG. 12 is a graph depicting a scrub mode according to still another exemplary embodiment of the disclosure.
Figure 17:
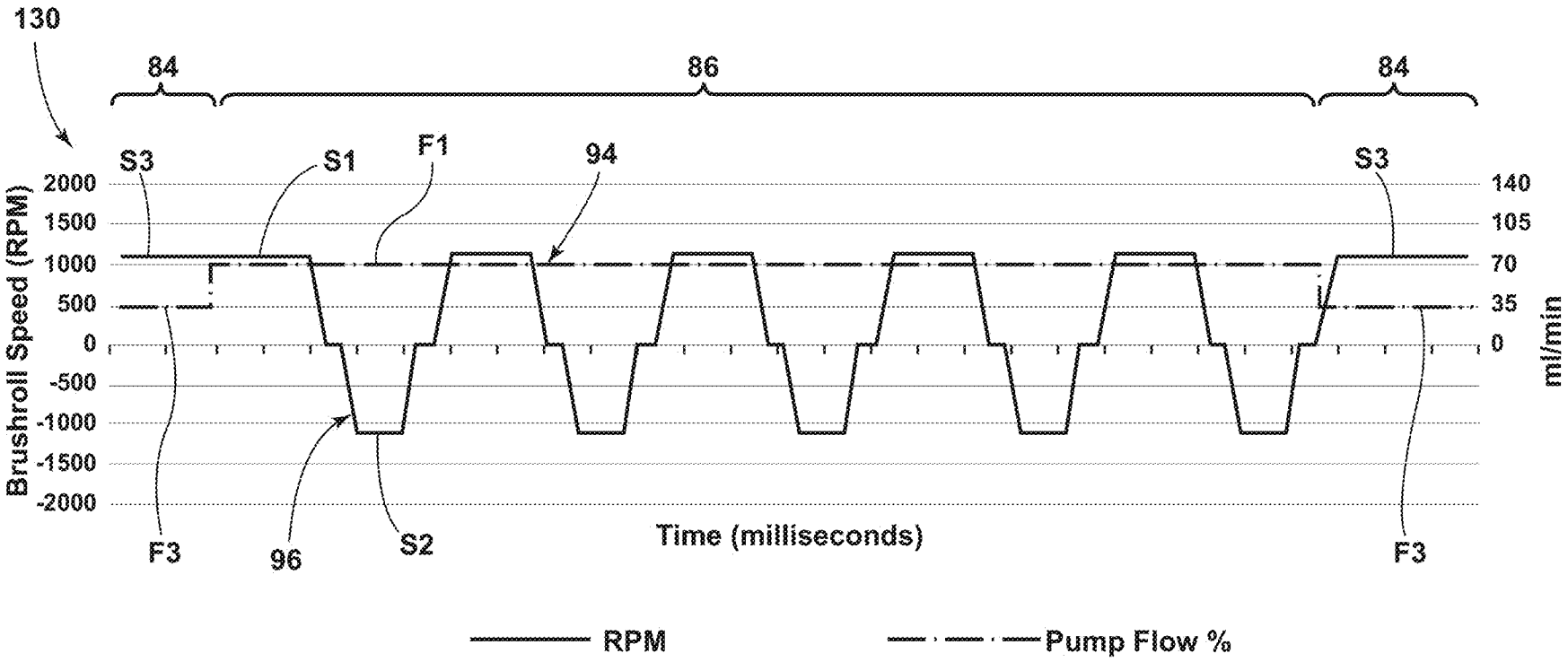
FIG. 17 is a graph depicting a scrub mode according to yet another exemplary embodiment of the disclosure.

Graphs depicting different embodiments of the scrub mode are presented in FIGS. 9-12 and 17, and show brushroll speed (RPM) versus time (t). Forward rotation is depicted as positive (+) RPM values and backward rotation is depicted as negative (−) RPM values. Vacuum motor and pump operation are also depicted in FIG. 12 as a percentage (%) of their maximum output/speed. Pump operation is also depicted in FIG. 17 as a flow rate (ml/min).

Figure 9:
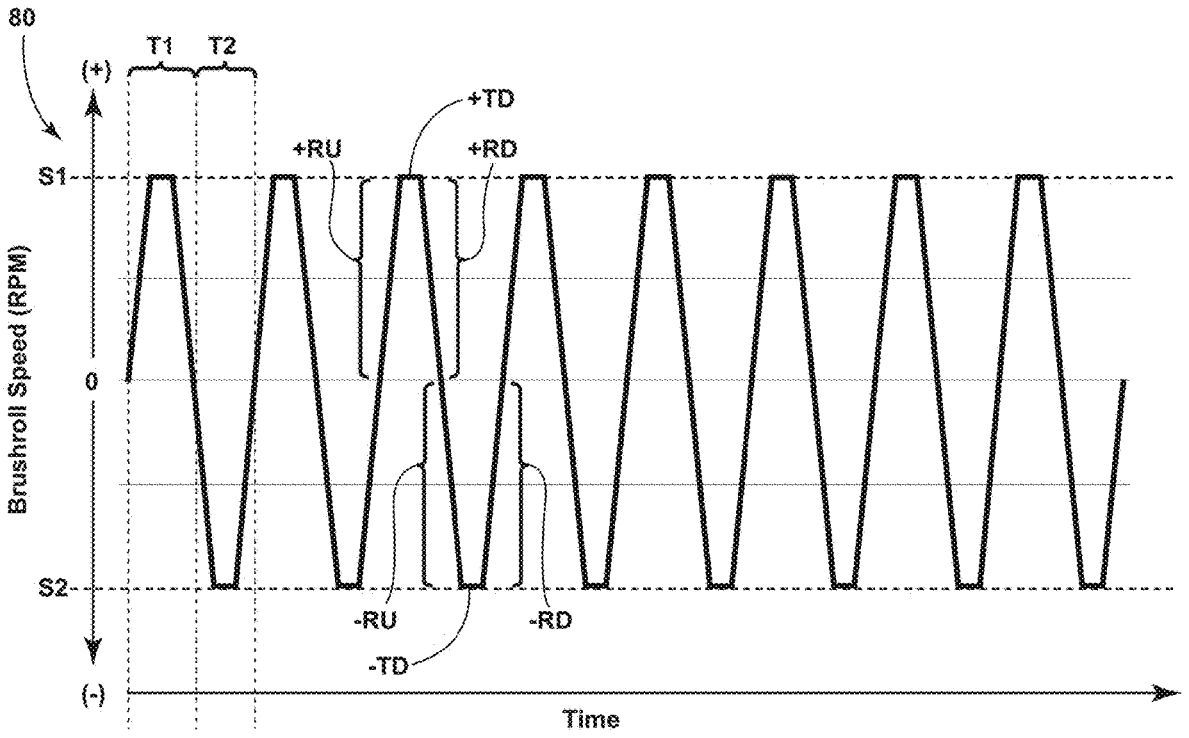
FIG. 9 is a graph depicting a scrub mode according to an exemplary embodiment of the disclosure.

FIG. 9 is a graph 80 showing a scrub mode being performed by the floor cleaner 10 according to one embodiment of the present disclosure. More particularly, as shown in FIG. 9, one scrub mode comprises several directional switches of the brushroll. As illustrated in FIG. 9 and with additional reference to FIG. 2, during the scrub mode the brushroll 46 oscillates between rotating forward (+RPM) and backward (−RPM). The brushroll motor 64 switches between rotating the brushroll 46 forwardly at a first speed S1 (for example, about +1000 RPM to +2000 RPM, alternatively about +1100 RPM) for a first period of time T1 (for example, about 100 to 500 milliseconds, alternatively about 330 milliseconds) and rotating the brushroll 46 backwardly at a second speed S2 (for example, about −1000 RPM to −2000 RPM, alternatively about −1100 RPM) for a second period of time T2 (for example, about 100 to 500 milliseconds, alternatively about 190 milliseconds). The period of oscillation is the time it takes for the brushroll 46 to complete one full oscillation or forward/backward rotation cycle (e.g., T1+T2), also referred to herein as a bidirectional cleaning cycle. The scrub mode includes a plurality of bidirectional cleaning cycles, and may also be referred to herein as a bidirectional scrub mode.

Each period of brushroll rotation can include a short ramp up period (also referred to herein as a ramp interval, e.g., a time interval where speed is increasing linearly) and a short ramp down period (also referred to herein as a braking interval, e.g., a time interval where speed is decreasing linearly) to protect the brushroll motor 64 by decreasing momentum and coming to a stop prior to making the direction switch. The intervals may be, for example, at least 10 ms, optionally between 10 ms and 200 ms, further optionally about 100 milliseconds, yet further optionally 10 ms and 40 ms, still further optionally about 15 ms. The braking interval may be the same or different than the ramp interval. Each period of brushroll rotation can include a dwell interval between the ramp up and ramp down periods during which speed is maintained at a constant value for a period of time, denoted as +TD for forward rotation and −TD for backward rotation. The dwell interval may be, for example, between 80 ms and 480 ms, alternatively between about 90 and 230 milliseconds. In FIG. 9, for forward rotation the ramp interval is denoted as +RU and the braking interval is denoted as +RD and for backward rotation the ramp interval is denoted as −RU and the braking interval is denoted as −RD. The dwell intervals+TD, −TD may be greater than the ramp and braking intervals +RU, +RD, −RU, −RD. In one embodiment, the ratio of dwell interval to ramp interval can be 5:1 to 1.5:1 and the ratio of dwell interval to braking interval can be 5:1 to 1.5:1.

Due to the short periods of time the brushroll motor 64 operates in each direction, the brushroll 46 rotates only briefly in each direction. More broadly, the brushroll 46 can rotate x-number of forward revolutions, followed by y-number of rearward revolutions, where x is greater than or equal to y. In one embodiment, each bidirectional cleaning cycle includes five forward (clockwise) revolutions, followed by three rearward (counter-clockwise) revolutions, with each revolution being 360-degrees. In another embodiment, the brushroll 46 completes the same number of revolutions forward and backward (e.g., five forward revolutions, followed by five rearward revolutions). For example, the brushroll 46 operating at 1200 rpm can rotate approximately 2-3 times (about 720-1080 degrees) and/or for about 100 to 150 milliseconds in the forward direction and can rotate approximately 2-3 times (about 720-1080 degrees) and/or for about 100 to 150 milliseconds in the backward direction. The bidirectional cleaning cycle is repeated until the scrub mode is disengaged. During the forward and rearward revolutions of the brushroll 46, the outer portion of the brushroll (e.g. the nap and/or bristles) engage with the surface being cleaned, helping to dislodge and remove difficult stains.

To distribute wear evenly across the brushroll 46, the brushroll motor 64 can over-rotate or under-rotate the brushroll 46 by a predetermined amount. For example, each bidirectional cycle can include an angular offset. In one embodiment, the motor controller 34 over-rotates or under-rotates the brushroll 46 by a predetermined amount, for example 90 degrees, before proceeding to the next bidirectional cycle. In other words, each bidirectional cycle includes at least one forward revolution, at least one rearward revolution, and an angular offset that is incorporated into the at least one forward revolution and/or the at least one rearward revolution. The motor controller 34 terminates power to the motor 64 in response to the scrub mode being disengaged, such that the brushroll stops in a random position relative to its starting position. Alternatively, the motor controller 34 operates the motor 64 in only the forward direction in response to the standard cleaning mode being engaged.

While a specific duty cycle for the scrub mode may be inferred from the graph shown in FIG. 9, it is understood that the number of directional switches is not limited to the number depicted in FIG. 9. Likewise, the time for the dwell intervals +TD and −TD vs. ramp and braking +RU, +RD, −RU, and −RD is not limited to the relative duration depicted in FIG. 9. Still further, while the brushroll speed is shown as starting and ending at zero, it is understood that the brushroll may be rotating at a non-zero speed before and/or after the scrub mode.

In one aspect of the disclosure, during the scrub mode the brushroll 46 can be indexed by rotating at different speeds S1, S2 and/or for different durations T1, T2 for forward and backward rotations, respectively. For example, the speed S1 can be greater than speed S2, speed S1 can be less than speed S2, time T1 can be greater than time T2, or time T1 can be less than time T2. With the speeds S1, S2 and/or time periods durations T1, T2 being unequal, a different portion of the brushroll 46 is indexed over the floor surface with each oscillation. At the end of one oscillation, the brushroll 46 is out of phase with respect to its beginning position of that oscillation. This indexing behavior ensures that a different portion of the brushroll surface, e.g., the nap, microfiber, or other agitation material, interfaces with the floor on each successive scrub mode. This has the advantage of maximizing cleaning efficacy by reducing potential for non-uniform wear on the brushroll, such as flat spots or matted down sections of nap developing over time.

FIG. 10 is a graph 82 showing a standard cleaning mode 84 and a scrub mode 86 being performed by the floor cleaner 10 according to another embodiment of the present disclosure. In this example, prior to and after the scrub mode 86, the floor cleaner 10 operates in the standard cleaning mode 84. When initially turned on (at Time 0), the floor cleaner 10 can operate in the standard cleaning mode 84, and upon initiation of the scrub mode 86, the floor cleaner 10 can operate in the scrub mode 86. After the scrub mode 86 is complete, the floor cleaner 10 can thereafter resuming the standard cleaning mode 84 or may end cleaning.

When transitioning from the standard cleaning mode 84 to the scrub mode 86, rotation of the brushroll 46 can be halted or slowed prior to beginning oscillation. In yet another embodiment, the brushroll motor can be deactivated (i.e., "turned off") prior to beginning oscillation for the scrub mode 86.

In FIG. 10, the brushroll 46 rotates in the forward direction during the standard cleaning mode 84 at the same speed S1 as the forward rotations during the scrub mode 86. In addition, during the scrub mode 86, the brushroll 46 can oscillate between rotating forward at speed S1 and backward at speed S2 having the same magnitude as speed S1. Alternatively, brushroll speed may be different during the standard cleaning and scrub modes, and/or may vary during the standard cleaning mode 84 and/or the scrub mode 86.

In FIG. 10, the brushroll 46 can oscillate between rotating forward and backward for the same periods of time, and the scrub mode 84 has a constant period of oscillation. Alternatively, time of rotation in either direction or the oscillation period may vary during the scrub mode 86.

When transitioning from the scrub mode 86 back to the standard cleaning mode, rotation of the brushroll 46 can be halted or slowed prior to resuming continuous forward rotation of the brushroll 46. In yet another embodiment, the brushroll motor can be deactivated (i.e., "turned off") prior to after the scrub mode 86.

FIG. 11 is a graph 88 showing an alternative to FIG. 10, where the speed S1 of the brushroll 46 during the forward rotations of the scrub mode 86 is higher than a speed S3 of the brushroll 46 during the standard cleaning mode 84. In addition, during the scrub mode 86, the brushroll 46 can oscillate between rotating forward at speed S1 and backward at speed S2 having a greater magnitude than speed S1. In other words, the brushroll 46 rotates faster in backward direction than the forward direction. Also as shown in FIG. 11, the brushroll 46 can rotate for longer during backward rotations than forward rotations. This speed and time differential results in indexing of the brushroll 46. At the end of one oscillation, the brushroll 46 is out of phase with respect to its beginning position of that oscillation. In the embodiment of FIG. 11, the brushroll 46 is about 60 degrees out of phase at the end of each oscillation.

For FIGS. 10-11, as discussed above, the scrub mode 86, once initiated, can run for a predetermined time or a variable time (e.g., depending on momentary switch 74 or information from stain sensor 76 or motion sensor 78). Resumption of the standard cleaning mode 84 after the scrub mode 84 can be automatically executed by the central controller 32 of the floor cleaner 10 or may be manually executed by the user.

As noted above for FIG. 9, a specific duty cycle for the scrub mode 86 may be inferred from the graphs shown in FIGS. 10-11, however, the scrub mode 86 is not so limited. Likewise, the duration of the standard cleaning mode 84 before and after the scrub mode 86 is not limited to the depiction in FIGS. 10-11.

FIG. 12 is a graph 90 showing a standard cleaning mode 84 and a scrub mode 86 being performed by the floor cleaner 10 according to another embodiment of the present disclosure. The graph 90 includes vacuum motor output represented by line 92 and pump output represented by line 94 in addition to brushroll speed represented by line 96. As described in further detail below, vacuum motor and/or pump output can vary during the scrub mode 86, including by increasing at least once, decreasing at least once, or turning "off" at least once. Variations in the vacuum motor and/or pump output can be timed with brushroll oscillations and/or with each other.

During the scrub mode 86, cleaning fluid is dispensed during at least a portion of the scrub mode. Cleaning fluid can be delivered in one application at or near the start of the scrub mode, in multiple applications during the scrub mode, or continuously throughout the scrub mode. Optionally, more cleaning fluid can be dispensed during the scrub mode 86 than during the normal cleaning mode 84, resulting in the dwell time of cleaning fluid during the scrub mode 86 being longer than the dwell time of cleaning fluid during the standard cleaning mode 84.

For scrub mode 86 shown in FIG. 12, cleaning fluid is dispensed from the fluid dispenser by varying the flow rate of the pump 44 between a first flow rate F1 (for example, about 75% of a maximum output of the pump) and a second flow rate F2 (for example, about 0% of a maximum output of the pump) that is less than the first flow rate F1. With the flow rate varying between a non-zero and zero output, the result is that cleaning fluid is dispensed in multiple, discreet applications of cleaning fluid.

In one embodiment, pump flow is increased at or near the beginning of the scrub mode 86. For example, the pump flow may be at a third flow rate F3 for the standard cleaning mode 84 and may ramp up to the first flow rate F1 after the scrub mode 86 initiates. This increases the amount of cleaning fluid on the floor when stain treatment begins.

In FIG. 12, the pump 44 is already in operation at the start of the scrub mode 86, and pump speed can be increased to increase the flow rate above that of the standard cleaning mode 84. For example, when the scrub mode 86 begins, the pump 44 can initially be operating to dispense cleaning fluid at the standard flow rate F3 (e.g., about 25% of a maximum speed of the pump 44) and can ramp up to dispense cleaning fluid at the scrub flow rate F1 (e.g., about 75% of maximum speed of the pump 44). In one example, the flow rate F1 is at least twice (e.g., 2×) the flow rate F3 during the standard cleaning mode 84, and optionally the ratio of the scrub mode flow rate to the normal mode flow rate can be about 2:1.

Cleaning fluid dispensing can be decreased or stopped completely (e.g., pump flow rate of 0%), at or near the beginning of backward brushroll rotation. In FIG. 12, the pump flow rate decreases to the second flow rate F2 during forward brushroll rotation, for example while the brushroll is rotating at speed S1. Stopping fluid dispensing prior to brushroll reversal can prevent or reduce cleaning liquid from sputtering out from the front of base 14 during backward rotation of the brushroll.

The pump flow rate may return to the higher flow rate F1 during each period of forward brushroll rotation to put a charge of cleaning fluid onto the floor and may drop to the lower flow rate F1 before each brushroll reversal. Other duty cycles are possible, such as the pump flow rate returning to the higher flow rate F1 during every other period of forward brushroll rotation, every third period of forward brushroll rotation, and so on.

During the scrub mode 86, debris and/or cleaning fluid can be extracted during at least a portion of the scrub mode 86. Debris and/or cleaning fluid can be extracted simultaneously while the brushroll 46 oscillates. Extraction can be performed throughout the scrub mode 86, at or near the end of the scrub mode, or in multiple periods during the scrub mode.

During the scrub mode 86, vacuum output can vary, including by decreasing at least once at the start of the scrub mode to a suction level V2 that is less than the suction level V1 during the standard cleaning mode 84. The term suction as used herein refers to a partial vacuum or negative pressure generated by the suction source of the floor cleaner 10. The magnitude of suction, i.e., the suction level or lift, can be indicated using various units of pressure from either of the Imperial and International System of Units (SI), such as inches of water, pounds per square inch, or pascals, for example. In one example, the suction level is decreased by at least half (e.g., 2×) for the scrub mode 86, and optionally the ratio of the scrub mode suction level to the normal mode suction level can be about 1:2. For scrub mode 86 shown in FIG. 12, the vacuum motor 56 is operated by varying suction between a first suction level V1 (for example, about 50% of a maximum speed of the vacuum motor) and a second suction level V2 (for example, about 25% of a maximum speed of the vacuum motor) that is less than the first suction level V1. The lower suction level V2 increases the dwell time of cleaning fluid dispensed to the floor, so that the cleaning fluid has a longer time to work on a stain (e.g., break down, loosen, release, lift, or any combination thereof, the stain) before being vacuumed up by the floor cleaner 10. Accordingly, the dwell time of cleaning fluid during the scrub mode 86, as described with respect to FIG. 12, is longer than the dwell time of cleaning fluid during the standard cleaning mode 84.

In one aspect of the disclosure, suction is decreased at or near the beginning of the scrub mode 86. For example, the vacuum motor may be operated at the first suction level V1 for the standard cleaning mode and may ramp down to the second suction level V2 after the scrub mode 86 initiates. The suction level may remain at the lower suction level V2 for the remainder of the scrub mode 86 such that extraction is performed throughout the scrub mode 86.

In FIG. 12, the vacuum motor 56 is already in operation at the start of the scrub mode 86, and vacuum motor speed can be decreased to decrease the vacuum motor speed below that of the standard cleaning mode 84. For example, when the scrub mode 86 begins, the vacuum motor 56 can initially be operating at the standard speed V1 (e.g., about 50% of the maximum speed of the vacuum motor 56) and can ramp down to the scrub speed (e.g., about 25% of the maximum speed of the vacuum motor 56). Preferably, vacuum motor speed is decreased immediately upon activation of the scrub mode 84, for example within the first 100 milliseconds of the scrub mode 86, or after a short delay.

In another aspect of the disclosure, suction may vary throughout the scrub mode 86, such as ramping down or up one or more times during the scrub mode 86. As but one example, suction can decrease during each forward rotation of the brushroll 46 and increase during each backward rotation of the brushroll 46.

In another aspect of the disclosure, suction may increase at or near the end of the scrub mode 86 to pick up any excess cleaning fluid dispensed to the floor during the scrub mode 86, which may be beneficial for scrub modes where extra cleaning fluid dispensed to the floor to help with stain treatment. During the final suction increase of the scrub mode, the pump 44 may be at 0% of a maximum output.

In the scrub mode 86 of FIG. 12, the brushroll 46 comes to rest before reversing directions, as represented by the brushroll speed remaining at zero for a period of time between changing directions, which represents a brake interval B. The predetermined brake interval B is optionally at least 10 ms, alternatively at least 10 ms and less than 100 ms, alternatively between 10 ms and 40 ms, alternatively about 15 ms. It is noted that the brake interval B when transitioning from forward rotation to backward rotation may be the same or different than the brake interval B when transitioning from backward rotation to forward rotation.

In one aspect of the disclosure, the scrub mode 86 can provide a second or scrub dwell time that is longer than the first or standard dwell time provided by the standard cleaning mode 86. The dwell times may be an average dwell time of cleaning fluid during the standard cleaning mode and scrub mode, respectively, as some variation of dwell time may occur throughout each mode since dwell time of cleaning fluid on the surface to be cleaned is dependent on fluid flow rate and suction level, and the fluid flow rate and/or suction level may vary during each mode. Increasing the dwell time, or average dwell time, during the scrub mode 84 lengthens the time the cleaning fluid has work on a stain (e.g., break down, loosen, release, lift, or any combination thereof, the stain) before being vacuumed up by the floor cleaner 10.

While a specific duty cycle for the standard cleaning mode and the scrub mode may be inferred from the graph shown in FIG. 12, it is understood that the modes are not so limited. For example, the vacuum motor 56, pump 44, and brushroll motor 64 may be activated during at least one portion or segment of each mode 84, 86, and such segments of activation may include periods of simultaneous, non-simultaneous, and/or overlapping activation.

Table 1 below lists some non-limiting examples of ranges operating parameters for the cleaning modes. Other operating parameters for the cleaning modes and other cleaning modes are possible, including, but not limited to, a standard "dry" cleaning mode in which cleaning fluid is not dispensed, e.g., the pump flow rate is zero.

TABLE 1

| Mode | Pump Flow Rate (ml/min) | Vacuum Motor Suction Power (% motor duty) | Brushroll Speed (RPM) |
|---|---|---|---|
| Standard Cleaning | 30-140 | 20-54% | +750-1100 (forward only) |
| Scrub Mode | 70 | 20% | +/−1000-2000 (oscillating) |

In a first example, the brushroll speed during standard cleaning may be about +1100 RPM and the brushroll speed during the scrub mode may be about +/−1700 RPM. Using a higher brushroll speed during the scrub mode provides faster agitation of the surface and may remove stains more quickly. This may be accompanied by a notable heat rise in the brush motor 64 during the scrub mode. As discussed in further detail below, to mitigate heat-buildup during the scrub mode, the floor cleaner 10 can have a thermal management component and/or a thermal management system that dissipates heat away from the motor 64.

In a second example, the brushroll speed during standard cleaning may be about +1100 RPM and the brushroll speed during the scrub mode may be about +/−1100 RPM. Using a brushroll speed for the scrub mode that is closer to or substantially the same as that of the standard cleaning mode can avoid a heat rise in the brush motor 64, lessening the need for an additional thermal management component and/or system. However, it is contemplated that a thermal management component and/or system may be included.

Use of the scrub mode as disclosed herein can reduce the effort expended by a user U by avoiding the need for making multiple passes or cleaning strokes because the scrub mode can effectively remove stains while the floor cleaner 10 is static. Additionally, it has been found that the scrub mode according to either of the first or second example above can remove a stain up to 50% faster than the standard cleaning mode. This is attributable the oscillating cleaning action of the brushroll, the longer dwell time of cleaning fluid, and one or more of the associated operating parameters for the brushroll motor 64, the pump 44, and/or the vacuum motor 56 during the scrub mode.

Additional improvements to the scrub mode have been observed by using longer brushroll fibers. In one example, the brushroll includes microfiber material having a fiber length, also referred to herein as nap length, of about 14 mm. Using longer fibers in combination with oscillating action has been found to clean larger stains better because it creates a bigger contact area between the brushroll and the surface. The nap length can be measured as the outstretched length of fibers above the backing of the microfiber material.

The scrub mode 84 shown in FIG. 12 includes indexing the brushroll 46 over the floor surface with each oscillation. In graph 90 shown FIG. 12, the time of backward rotation T2 is less than the time of forward rotation T1, resulting in a different portion of the brushroll 46 being indexed over the floor surface with each oscillation. Optionally, the ratio of the time of forward rotation T1 to the time of backward rotation T2 is in the range of 3:1 to 1:1, alternatively about 2:1, alternatively about 1.6:1. Alternatively or additionally, to index the brushroll 46, the forward and rearward speeds S1, S2 may be different.

The scrub mode according to any aspect disclosed herein can include visual or audible notifications to the user, including one or more of: providing a visual notification to the user indicative of a start of the scrub mode, providing an audible notification to the user indicative of a start of the scrub mode, providing a visual notification to the user indicative of an end of the scrub mode, or providing an audible notification to the user indicative of an end of the scrub mode. An audible notification can be issued from a speaker of the floor cleaner 10 and a visual notification can be presented on a display of the floor cleaner 10.

In addition to or as an alternative to active notifications, the scrub mode can provide passive notification. Noise output by the floor cleaner 10 may increase during the scrub mode by the oscillation action of the brushroll 46. This can give the user feedback that the scrub mode is in operation.

In one aspect of the disclosure, the floor cleaner 10 can include a floor type sensor configured to sense (directly or by inference) whether the surface to be cleaned is a hard floor surface or a soft floor surface such as carpet or a rug. Input from the floor type sensor, which can be provided to the controller 32, can be used to enable the scrub mode when the floor cleaner 10 is on a hard floor and disable or lock-out the scrub mode when the floor cleaner 10 is not on a hard floor, e.g., when a soft floor is detected or when the floor cleaner 10 is on a charging tray.

Referring to FIGS. 3 and 13, in one aspect of the disclosure, before, during, or after the scrub mode, the floor cleaner 10 can be configured to refresh the brushroll 46 by performing refreshing maneuver to lift or re-fluff the nap of the brushroll. The refreshing maneuver can comprise: (i) moving a portion of the brushroll 46 past the interference wiper 68 (FIG. 3) and/or past the suction guard 98 (FIG. 13) and then moving said portion of the brushroll back into engagement with the floor F, either by rotating a full 360 degrees or by reversing the direction of rotation; (ii) moving a portion of the brushroll 46 past the suction inlet port 60 and then moving said portion of the brushroll back into engagement with the floor F, either by rotating a full 360 degrees or by reversing the direction of rotation; (iii) temporarily increasing rotation speed; or any combination thereof.

Referring to FIG. 13, in another aspect of the disclosure, at least some embodiments of the floor cleaner 10 can have a brushroll height setter 100 configured to engage the brushroll 46 and/or a portion of the base 14 including the brushroll 46 to set the height of the brushroll relative to the floor F. Brushroll height can be adjusted for the scrub mode to increase engagement of the brushroll 46 with the surface to be cleaned, which can be accomplished by decreasing the distance between the brushroll axis X and the surface to be cleaned, e.g., by "lowering" the brushroll 46. The height setter 100 can set the brushroll 46 at a first height setting in the standard cleaning mode and set the brushroll 46 at a second, different height setting in the scrub cleaning mode. The brushroll height setter 100 can adjust the position of the brushroll 46 by lowering the brushroll 46 and/or a portion of the base 14 including the brushroll 46 and/or entire base 14 closer to floor F during the scrub mode.

Figure 14A:
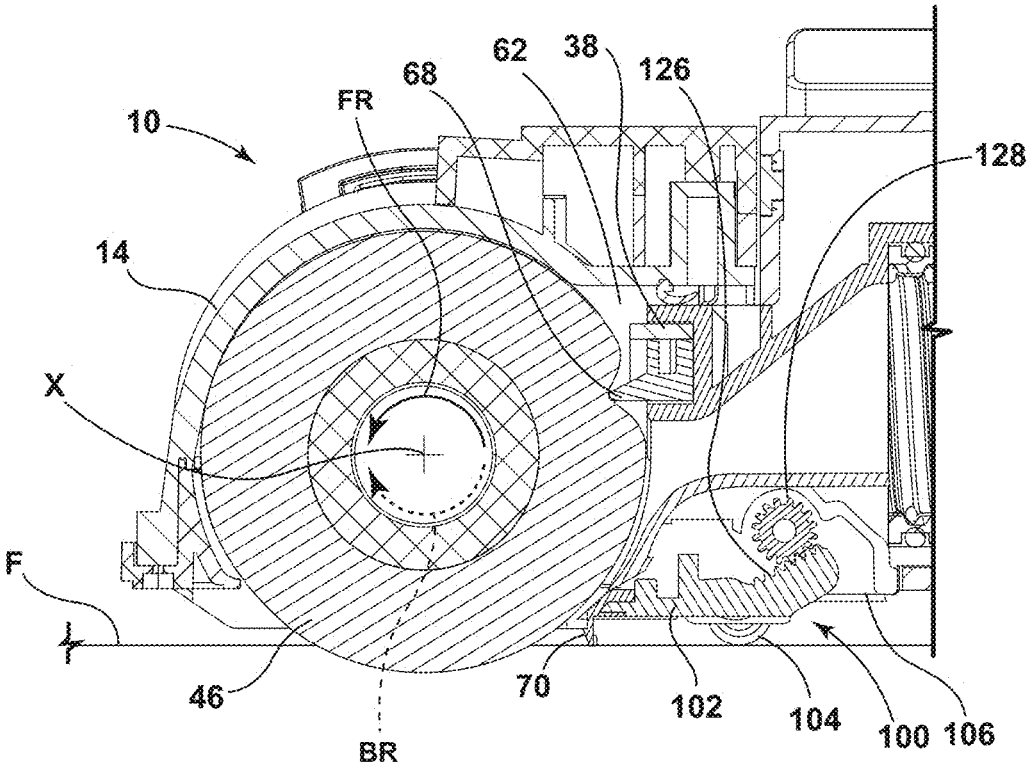
FIG. 14A is a sectional view of the floor cleaner base having a brushroll height setter according to another aspect of the disclosure, and showing the brushroll at a first height setting in a standard cleaning mode.
Figure 14B:
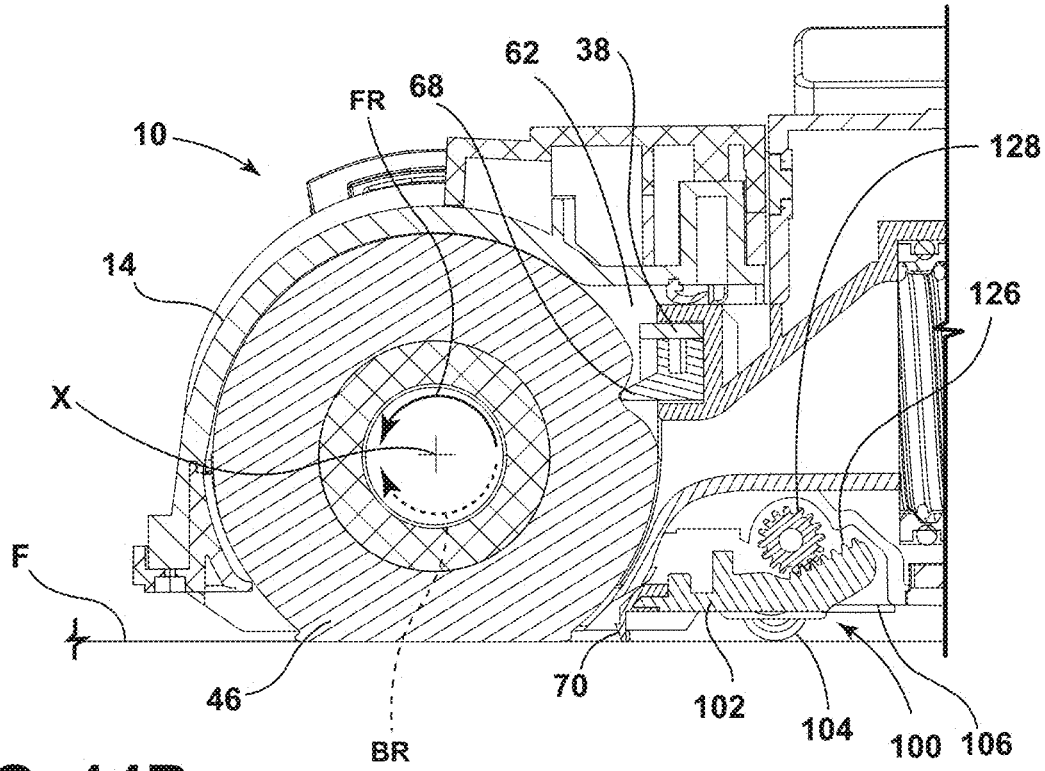
FIG. 14B is a sectional view of the floor cleaner base of FIG. 14A, and showing the brushroll at a second (reduced) height setting in a scrub mode.

Referring to FIG. 14A-14B, one embodiment of a height setter 100 is shown and can set the brushroll 46 at a first height setting in the standard cleaning mode (as shown in FIG. 14A) and set the brushroll 46 at a second, different height setting in the scrub cleaning mode (as shown in FIG. 14B). For example, the floor cleaner 10 can comprise a wheeled carriage 102 on the base 14 to raise and lower a front portion of the base 14 to regulate the height of the brushroll 46 located inside the base 14 relative to the surface being cleaned, in which case the adjustment associated with the scrub mode comprises decreasing a distance between one or more wheels 104 on the carriage 102 and a bottom 106 of the base 14 to lower the brushroll 46 closer to the floor F.

The height setter 100 can include any suitable mating feature configurable to move the carriage 102 relative to the bottom 106 of the base 14, such as a cam or a rack and pinion gear, for example. In the embodiment shown, the carriage 102 comprises a rack gear 126 and the base 14 comprises a pinion gear 128 is mounted at a fixed location relative to the bottom 106 of the base 14 in engagement with the rack gear 126. The pinion gear 128 rotates about a fixed axis to move the rack gear 126 back and forth, which in turn moves the front portion of the base 14 relative to the floor F. As shown in FIG. 14A, rotating the pinion gear 128 to move the rack gear 126 forward raises the front portion of the base 14. As shown in FIG. 14B, rotating the pinion gear 128 to move the rack gear 126 rearward lowers the front portion of the base 14.

The height setter 100 can be automated, such that the brushroll height is automatically adjusted based on the mode of operation. For example, the controller 32 (FIG. 2) can be configured to control the height setter 100, and as part of executing the scrub mode, the controller can lower the brushroll 46 to the second height (FIG. 14B). As part of resuming the standard cleaning operation after the scrub mode, the controller 32 can raise the brushroll 46 to the first height (FIG. 12).

Utilizing the height setter 100 disclosed herein, the floor cleaner 10 can apply different amounts of floor engagement with the brushroll 46 and can easily adjust to apply more floor engagement for scrubbing a stubborn stain on the surface to be cleaned.

The height setter 100 can comprise the squeegee 70 that wipes residual liquid from the floor F, with the squeegee 70 integrated with a portion of the height setter that moves relative to the bottom 106 of the base 14. For example, the squeegee 70 can be coupled with the carriage 102 and disposed behind the brushroll 46. As the carriage 102 moves to raise or to lower the front portion of the base 14 to regulate the height of the brushroll 46, the orientation and engagement of the squeegee 70 with the floor F is unchanged. This supports liquid recovery and floor cleaning in all height settings.

Figure 15:
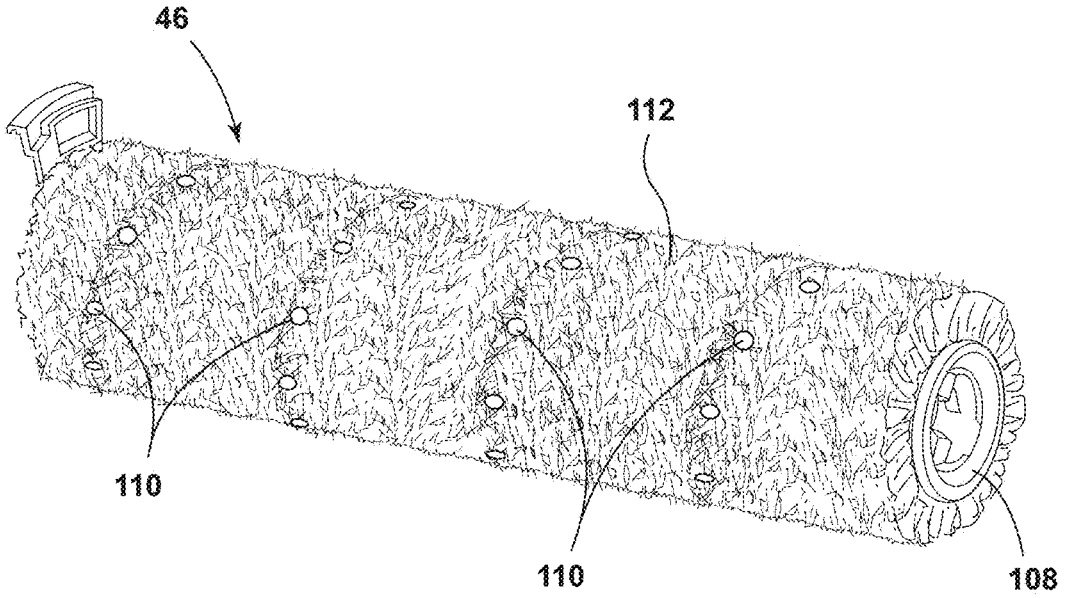
FIG. 15 is a perspective view of a brushroll for the floor cleaner according to an exemplary embodiment of the disclosure.

FIG. 15 shows one embodiment of the brushroll 46, where the brushroll 46 includes a dowel 108 supporting at least one agitation element. The agitation element can comprise a plurality of bristles 110 extending from the dowel 108, with microfiber material 112 arranged around and/or between the bristles 110. The bristles 110 can be tufted or unitary bristle strips and constructed of nylon, or any other suitable synthetic or natural fiber. The microfiber material 112 can be constructed of polyester, polyamides, or a conjugation of materials including polypropylene or any other suitable material known in the art from which to construct microfiber. Other aspects of brushrolls in accordance with the present disclosure can have different configurations and utilize different materials, such as a bristle-only brushroll comprising bristles 110 and no microfiber material or a microfiber-only brushroll comprising microfiber material 112 and no bristles. The bristles 110 can include a length that is greater than 7 mm, optionally between 10 mm and 20 mm, further optionally equal to or less than 14 mm, such as 10-12 mm.

The bristles 110 can be shorter than, generally the same length as, or longer than the microfiber material 112. In an embodiment where the height of the brushroll 46 is set by the brushroll height setter 100, the bristles 110 can be shorter than the microfiber 112, and have a length configured such that the bristles 110 only contact the floor F when the floor cleaner 10 is in the scrub cleaning mode. The microfiber 112 can contact the floor F when the floor cleaner 10 is in either of the standard cleaning mode or in the scrub cleaning mode. In one example, the microfiber material 112 has a fiber length of about 14 mm, and the bristles 110 have a length less than 14 mm, for example 12 mm, alternatively 10 mm.

The bristles 110 can be angled to provide more aggressive scrubbing action during scrub mode. For example, the bristles 110 can be perpendicular to the outer surface of the dowel 108 or angled up to 45 degrees away from perpendicular.

Figure 16:
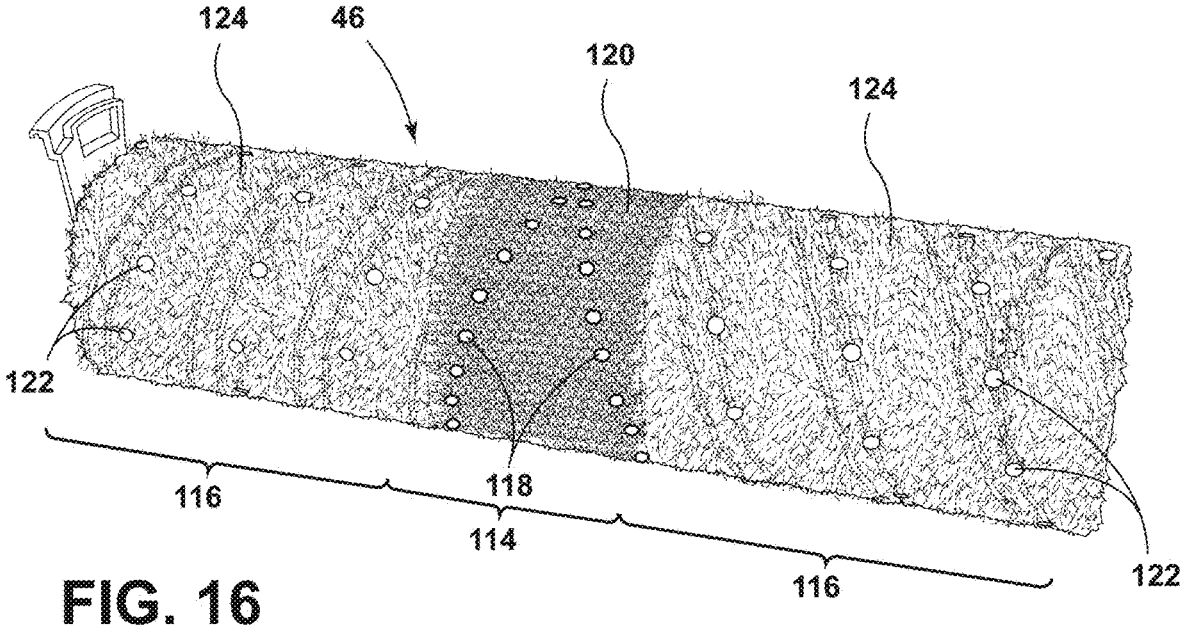
FIG. 16 is a perspective view of a brushroll for the floor cleaner according to another exemplary embodiment of the disclosure.

FIG. 16 shows another embodiment of the brushroll 46, where the brushroll 46 comprises a scrubbing zone 114 bordered by outer cleaning zones 116. The scrubbing zone 114 is configured to enhance the removal of stubborn stains. The scrubbing zone 114 can comprise bristles 118, microfiber material 120, and/or a combination of bristles 118 and microfiber material 120. The outer cleaning zones 116 can comprise bristles 122, microfiber material 124, and/or a combination of bristles 122 and microfiber material 124. The brushroll 46 can also include a dowel (not shown).

The scrubbing zone 114 can differ from the outer zones 116 in having: (1) greater bristle density (e.g., the number of bristles 118 per surface area in the scrubbing zone 114 is greater than the number of bristles 122 per surface area in the outer zones 116); (2) only bristles 118 and no microfiber in the scrubbing zone 114 (versus the outer cleaning zones 116 comprising a combination of bristles 122 and microfiber material 124 or only microfiber material 124); (3) shorter microfiber (e.g., the length of the microfiber material 120 in the scrubbing zone 114 is less than the length of the microfiber material 124 in the outer zones 116); (4) angling the bristles 118 in the scrubbing zone to provide a more aggressive scrub during backward rotation of the brushroll; or any combination thereof.

Some parameters of the brushroll 46 that improve scrubbing include, but are not limited to: (1) the scrubbing zone 114 having a bristle density of two to three times the bristle density of the outer zones 116; (2) the bristles 118 in the scrubbing zone 114 being shorter than or equal in length than the microfiber 120; (3) the scrubbing zone microfiber 120 having a nap length of 3-10 mm and the outer zone microfiber 124 having a nap length of 14 mm, optionally with the dowel in the scrubbing zone 114 having a greater diameter so that the overall outer diameter of the brushroll 46 is consistent from end-to-end; (4) the bristles 118 in the scrubbing zone 114 being perpendicular to the dowel surface or angled up to 45 degrees away from perpendicular; or any combination thereof.

The scrubbing zone 114 can constitute at least 10% to 50% of the brushroll 46 in total, with the outer cleaning zones 116 making up the remaining length. Alternatively, the scrubbing zone 114 can constitute 15% to 40%, or 20% to 30% of the brushroll 46. The outer zones 116 can preferably form equal portions of the brushroll 46, such that the scrubbing zone 114 is positioned at the center of the brushroll 46. Alternatively, the outer zones 116 can be unequal, such that the scrubbing zone 114 is positioned off center, though the scrubbing zone 114 may still encompass a center of the brushroll 46.

In one aspect of the disclosure, the scrubbing zone 114 can have a contrasting color to the outer zones 116 so that a user can line up the scrubbing zone 114 with a stain, for example by viewing the scrubbing zone 114 through a transparent cover on the base 14 (FIG. 1).

In an embodiment where the height of the brushroll 46 is set by the brushroll height setter 100, the bristles 118 in the scrubbing zone 114 can be shorter than the microfiber 120 in the scrubbing zone 114, and have a length configured such that the bristles 118 in the scrubbing zone 114 only contact the floor F when the floor cleaner 10 is in the scrub cleaning mode. The microfiber 120 in the scrubbing zone 114 can contact the floor F when the floor cleaner 10 is in either of the standard cleaning mode or in the scrub cleaning mode. The bristles 122 in the outer cleaning zones 116 can be shorter than, generally the same length as, or longer than the microfiber material 124 in the outer cleaning zones 116.

The brushrolls 46 shown in FIGS. 15 and 16 are suitable for use on both hard and soft surfaces, and for wet or dry vacuum cleaning. Alternatively, or in addition, the floor cleaner 10 can be provided with multiple, interchangeable brushrolls that allow for the selection of a brushroll depending on the cleaning task to be performed, the floor type of be cleaned, or other factors.

FIG. 17 is a graph 130 showing a standard cleaning mode 84 and a scrub mode 86 being performed by the floor cleaner 10 according to yet another embodiment of the present disclosure. The scrub mode depicted in FIG. 17 may be substantially similar to the scrub mode depicted in FIG. 12, save that the brushroll speed, as represented by line 96, for the scrub mode 86, switches between speeds S1, S2 that have the same, or substantially the same, magnitude as the brushroll speed S3 during the standard cleaning mode 84. In one non-limiting example, the speed S3 during standard cleaning is +1100 RPM and the speed during the scrub mode switches between +1100 RPM and −1100 RPM.

Another difference may be the dispensing of fluid. During the scrub mode 86, pump output can vary, including by increasing at least once in response to initiation of the scrub mode to a flow rate F1 that is greater than the flow rate F3 during the standard cleaning mode 84. For example, the flow rate F1 is at least twice (e.g., 2×) the flow rate F3 during the standard cleaning mode 84, and optionally the ratio of the scrub mode flow rate to the normal mode flow rate can be about 2:1. In one non-limiting example, the flow rate F3 during standard cleaning is about 35 ml/min and the flow rate F1 during the scrub mode is about 70 ml/min. It is noted that increasing pump output at least once in response to initiation of the scrub mode, includes, unless otherwise noted, increasing pump output at the start of the scrub mode, increasing pump output just prior to the start of the scrub mode, or increasing pump output after the start of the scrub mode.

Also during or after the scrub mode 86, pump output can decrease at least once in response to the end of the scrub mode. For example, the pump output can decrease from flow rate F1 to a lower flow rate, such as but not limited to the flow rate F3 associated with the standard cleaning mode 84, in response to the end of the scrub mode. It is noted that decreasing pump output in response to the end of the scrub mode, includes, unless otherwise noted, decreasing pump output at the end of the scrub mode, decreasing pump output just prior to the end of the scrub mode, or decreasing pump output after the end of the scrub mode.

While not depicted in FIG. 17, during the scrub mode 86, vacuum output can vary as described above with reference to FIG. 12. For example, the vacuum motor speed during the scrub mode 86 be less than the vacuum motor speed during the standard cleaning mode 84. The lower suction level during scrub mode increases the dwell time of cleaning fluid dispensed to the floor, so that the cleaning fluid has a longer time to work on a stain (e.g., break down, loosen, release, lift, or any combination thereof, the stain) before being vacuumed up by the floor cleaner 10.

Figure 18:
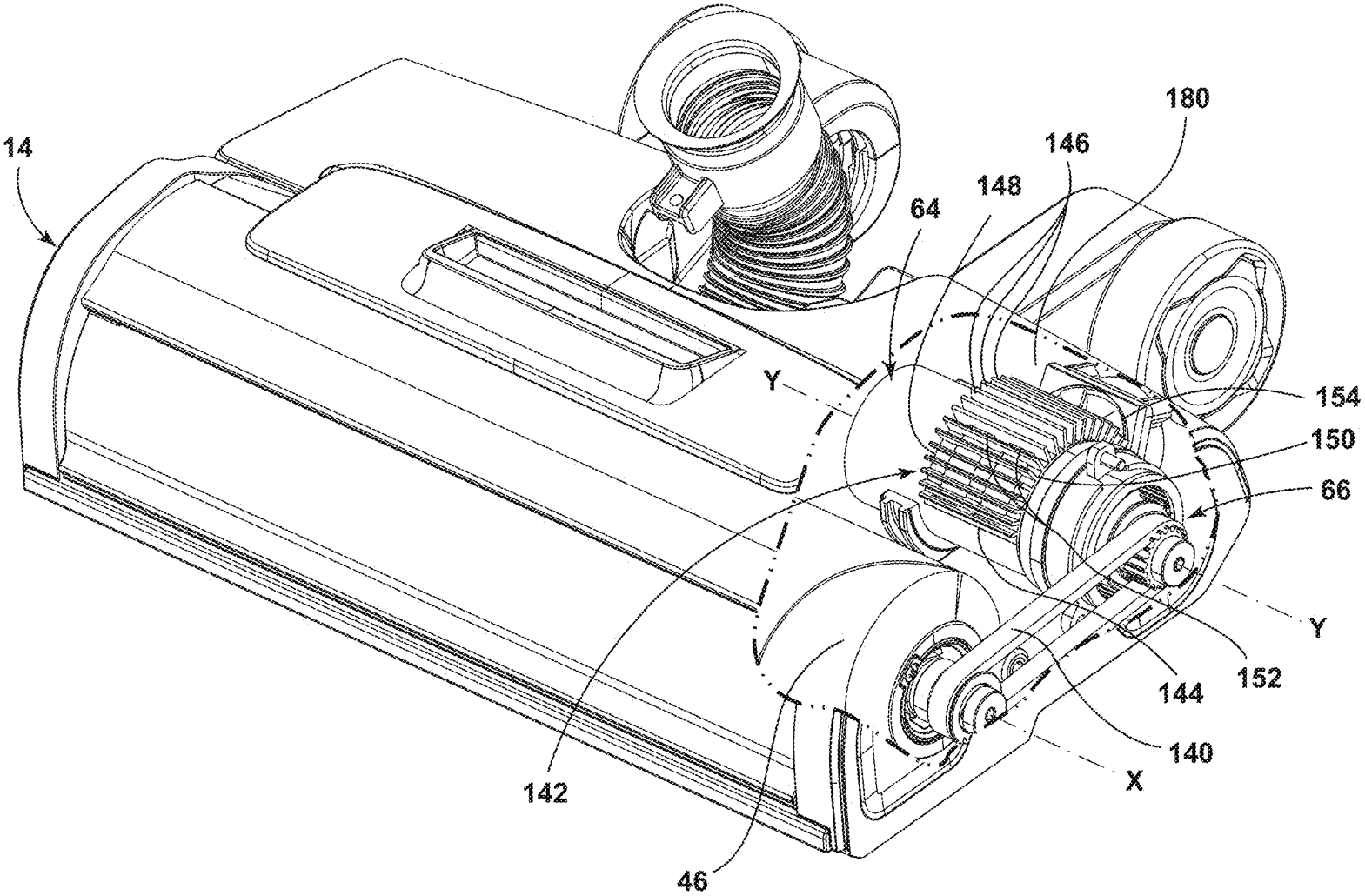
FIG. 18 is a perspective view of a cleaning base for the floor cleaner having a heat sink with axial fins for cooling the brush motor according to an exemplary embodiment of the disclosure.

FIG. 18 is a perspective view of a cleaning base 14 for the floor cleaner 10 according to another aspect of the disclosure. In FIG. 18 a portion of the base 14 is cutaway for clarity, showing the brushroll motor 64 and drive transmission with the brushroll 46. A drive transmission 66 operably connects the motor 64 with the brushroll 46 to rotate the brushroll 46, and can comprise one or more belts, pulleys, gears, or the like for transmitting rotational motion of the motor 64 to the brushroll 46. In the embodiment illustrated, the drive transmission 66 includes, at least, a belt 140 coupling the motor 64 with the brushroll 46. The brushroll motor 64 can be a brushless DC motor. Alternatively, a brushed DC or AC motor can be used.

It will be appreciated that during operation of the floor cleaner 10 in the scrub mode, in which the brushroll 46 is oscillated back and forth by the motor 64, high temperatures may build up within and around the motor 64. Without managing this heat, the motor 64 may overheat. Overheating can cause the motor 64 to become less efficient, drawing more current than is necessary. In some circumstances, overheating can lead to motor failure. This problem is compounded by the fluid dispensing function because the motor 64 requires a liquid-tight enclosure to prevent cleaning fluid from entering the motor 64 and damaging it, and further because limited space is available in the base 14 due to the presence of fluid-carrying components like the dispenser 38 and/or the pump 44, both of which may limit practical options for heat management.

To mitigate heat-buildup during the scrub mode, and also during normal operation of the floor cleaner 10, the floor cleaner 10 can have a thermal management component configured to dissipate heat away from the brushroll motor 64, ensuring its uninterrupted, reliable operation and/or overall longer operation (run) time.

In the embodiment of FIG. 18, the thermal management component includes an air-cooled heat sink 142. The air-cooled heat sink 142 includes an arcuate sleeve 144 that conforms to an exterior surface of the brushroll motor 64, optionally being secured thereto via a thermally conductive adhesive paste. The heat sink 142 also includes axial fins 146 integrally joined to the sleeve 144. The heat sink 142 may be made of aluminum, copper, or other thermally-conductive material. The fins 146 extend longitudinally from a first axial end 148 of the sleeve 144 to a second axial end 150 of the sleeve 144.

Optionally, the base 14 has an additional thermal management component in the form of a cooling fan 154 mounted at a side of the brushroll motor 64, e.g. externally of the motor 64 and radially spaced from the motor axis Y, and oriented to direct a cooling airflow tangentially over the heat sink 142. The axial fan 154 4 can be a blower or an extractor fan, depending on the fan blade orientation. The fan 154 blows or pulls air tangentially around the heat sink and improves the cooling efficiency of the heat sink 142 by facilitating forced convection to promote increased heat dissipation in the base 14 around the motor 64.

In operation, heat from the brushroll motor 64 is transferred to the sleeve 144 via conduction. As heat moves into the fins 146, the heat is dissipated into the surrounding air via convection. The increased surface area afforded by the fins 146 allows more air to flow over them, helping carry the heat away. The fins 146 can optionally include through-holes 152, for example two through-holes per fin 146, particularly in embodiments in which a side-mounted cooling fan 154 directs air in a tangential direction as generally shown in FIG. 18. In other embodiments a fan is omitted, and air is passively directed over and/or through the fins 146 without the aid of a fan.

Figure 19:
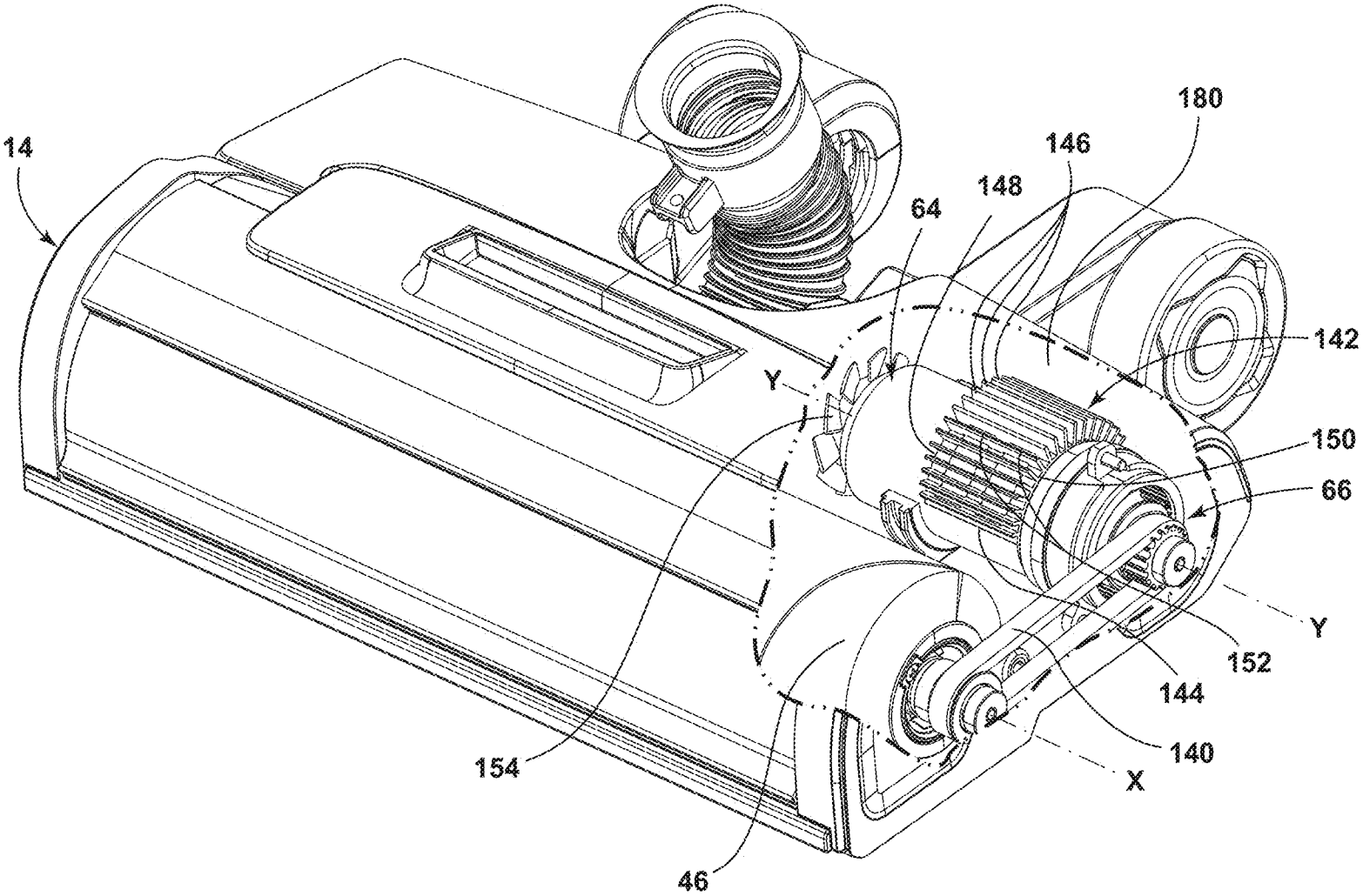
FIG. 19 is a perspective view of a cleaning base for the floor cleaner having a heat sink and a cooling fan for cooling the brush motor according to another exemplary embodiment of the disclosure.

Various other configurations for the heat sink 142 are possible. While the fins 146 shown in FIG. 18 extend parallel to a central axis Y of the brushroll motor 64, in other embodiments the fins 146 may be skewed, curved, or wave-shaped to increase the surface area of the fins 146 and to promote increased heat exchange. Still other embodiments are also contemplated. In the embodiment of FIG. 19, for example, the cooling fan 154 can be a stirring fan attached to the shaft of the brushroll motor 64 and directs air in an axial direction, parallel to the axial fins 146. In yet another embodiment (not shown) the cooling fan 154 can be disposed on an axial end of the brushroll motor 64 to direct air along the fins 146, and is aligned with the motor axis Y but is external to the motor 64.

Figure 20:
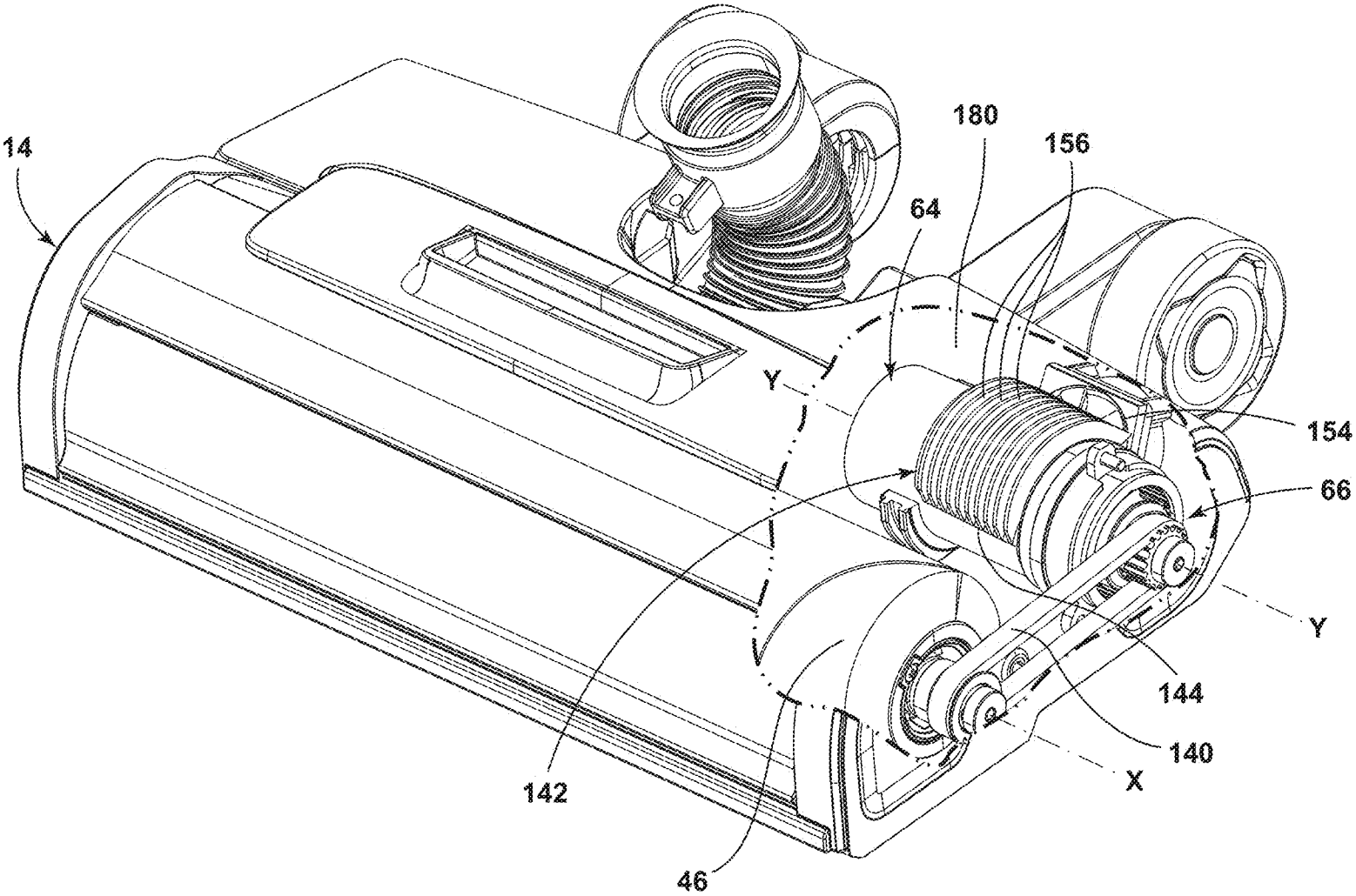
FIG. 20 is a perspective view of a cleaning base for the floor cleaner having a heat sink with circumferential fins for cooling the brush motor according to yet another exemplary embodiment of the disclosure.

Referring to FIG. 20, in still other embodiments, the heat sink 142 has fins 156 that extend in the circumferential direction. The circumferential fins 156 extend around at least a portion of the circumference of the motor 64. In contrast to the embodiment of FIG. 18, the fins 156 are arranged radially about the central axis Y of the brushroll motor 64. In still other embodiments, the fins extend helically. In yet other embodiments, the heat sink 142 can have no fins, particularly where fins are impractical due to space considerations. In this example, the heat sink 142 can include an arcuate sleeve that conforms to the surface of the brushroll motor 64. Heat is dissipated from the heat sink 142 via convection as air passes over the arcuate sleeve.

Figure 21:
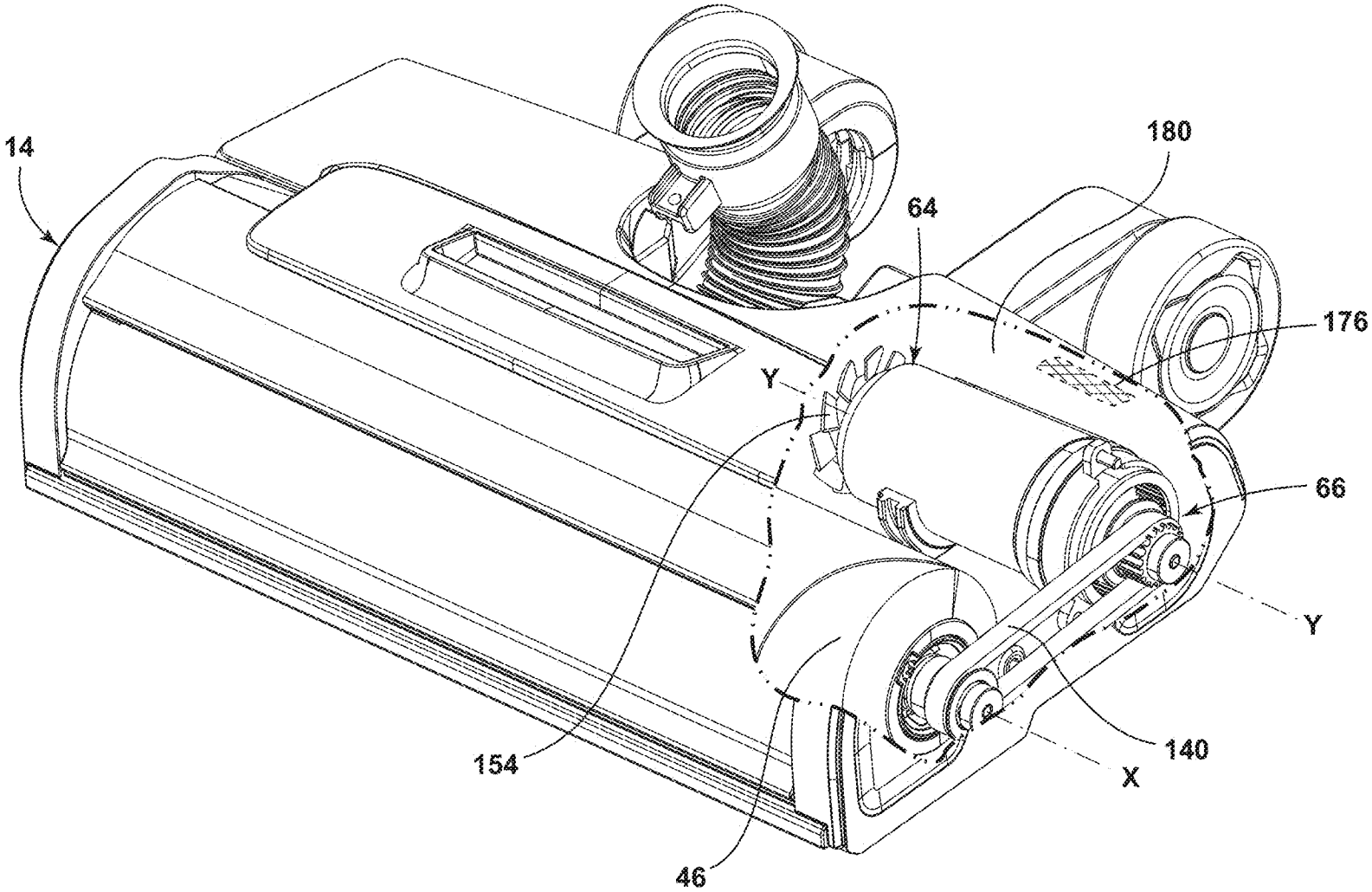
FIG. 21 is a perspective view of a cleaning base for the floor cleaner having a cooling fan for cooling the brush motor according to still another exemplary embodiment of the disclosure.

Referring to FIG. 21, as yet another example, the thermal management component can have the stirring fan 154 attached to the shaft of the brushroll motor 64 and no heat sink, particularly where fins are impractical due to space considerations. Heat is dissipated from the motor 64 via convection as air passes over the motor 64. Yet other thermal management components are contemplated instead of or in addition to the heat sink 142 and/or the fan 154, including those relying on liquid cooling or air cooling. Yet another contemplated thermal management component is thermal tape that runs from the brushroll motor 64 to other parts of the floor cleaner 10 to dissipate heat to other parts of the floor cleaner 10.

Figure 22:
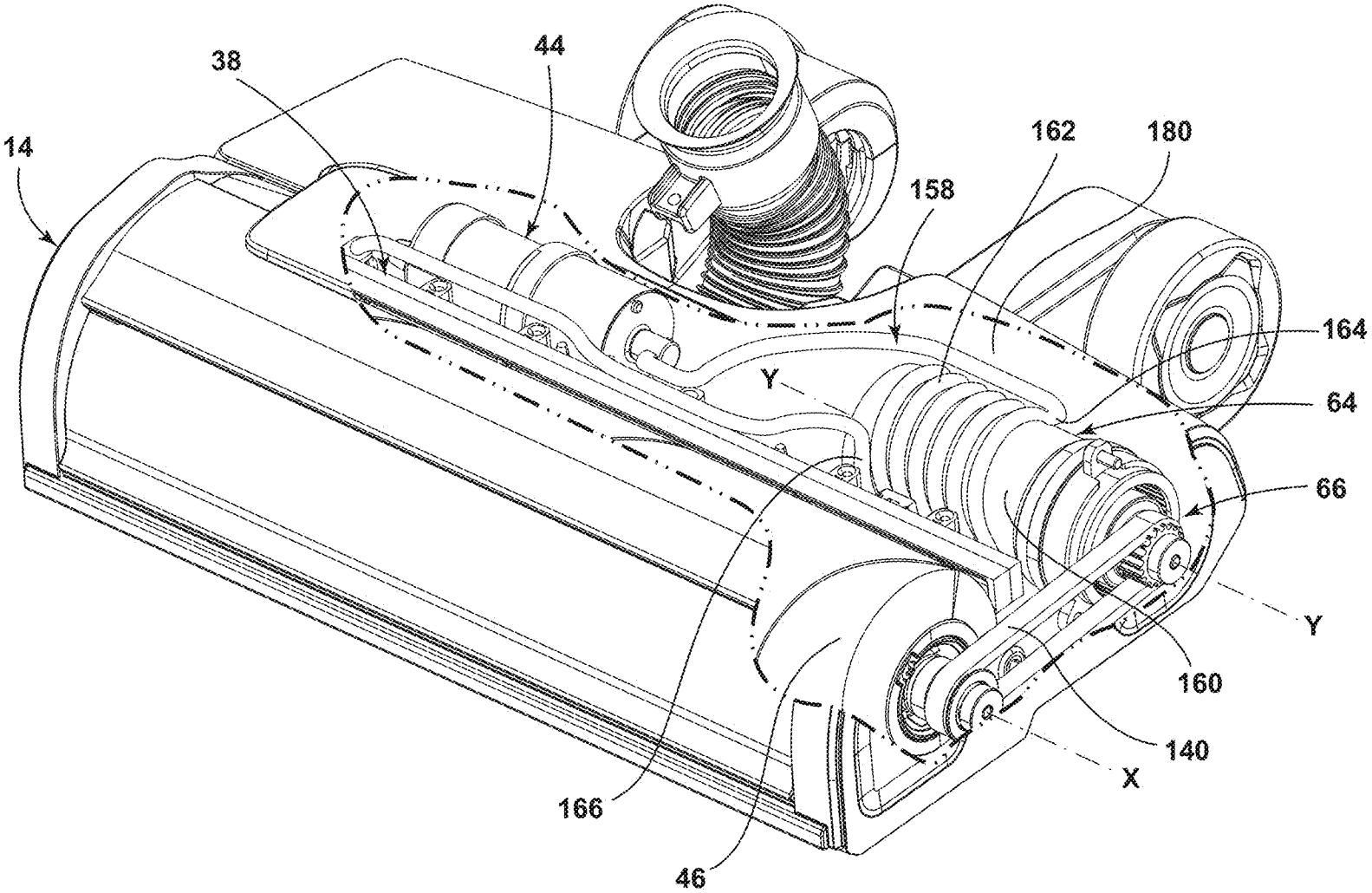
FIG. 22 is a perspective view of a cleaning base for the floor cleaner having a liquid cooling coil for cooling the brush motor according to a further exemplary embodiment of the disclosure.

For example, and with reference to FIG. 22, in one embodiment the floor cleaner 10 can have a liquid-cooled heat exchange system that circulates cleaning fluid from the tank 20 (FIG. 1) past the motor 64 to remove heat therefrom. The heat exchange system can include at least one cooling line 158 that passes in close thermal contact with the motor 64 or a jacket 160 enclosing the motor 64, where the cooling line 158 receives cleaning fluid from the tank 20, optionally via the pump 44. The cooling line 158 can deliver the heated cleaning fluid to the dispenser 38.

In the embodiment of FIG. 22, the cooling line 158 can include a thermally conductive coil 162 that wraps a plurality of times around the motor 64 and has an inlet end 164 in fluid communication with the pump 44 and an outlet end 166 in fluid communication with the dispenser 38. The conductive coil 162 can be made from aluminum, copper, or other high thermally-conductive material.

Figure 23:
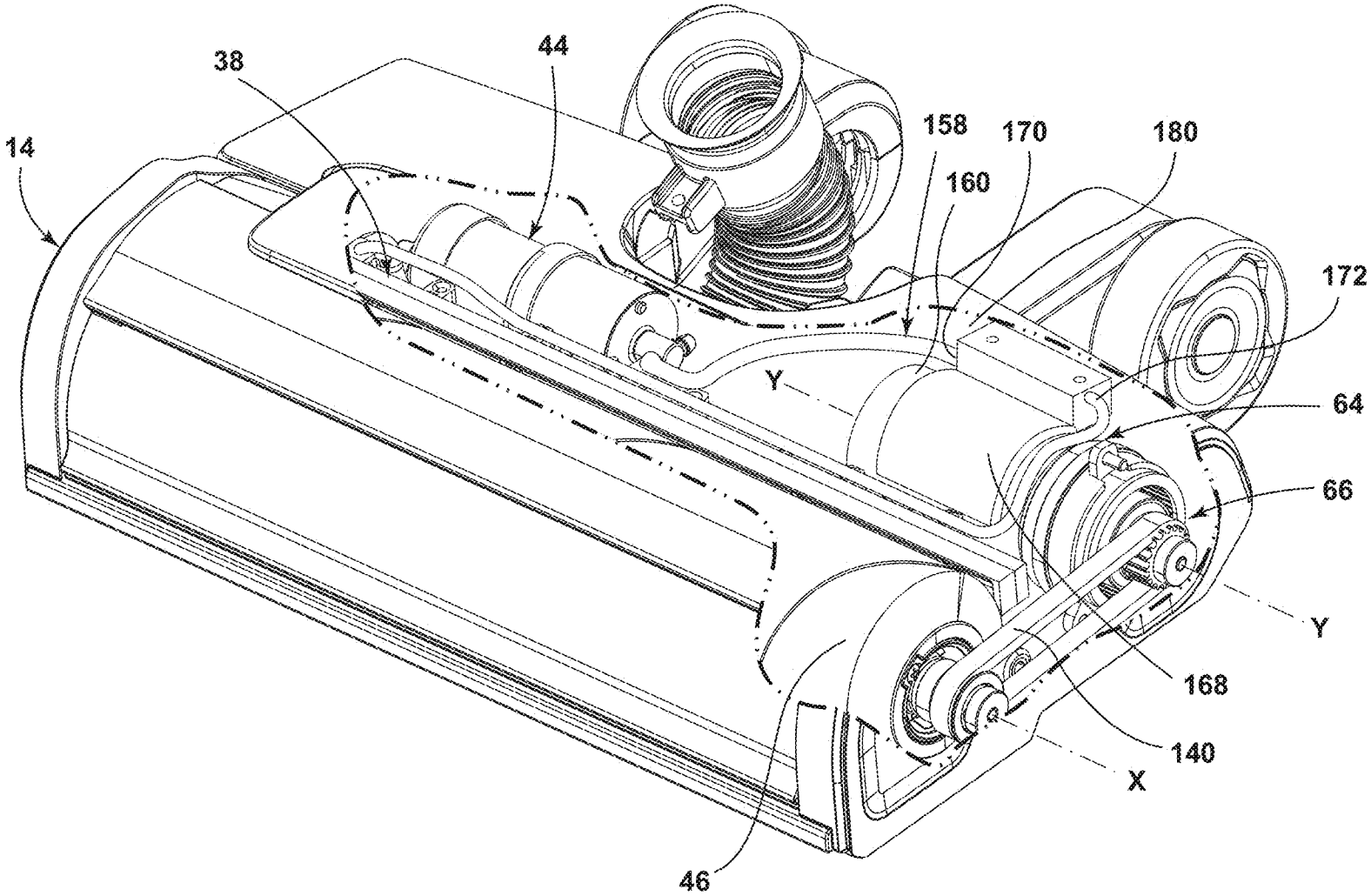
FIG. 23 is a perspective view of a cleaning base for the floor cleaner having a liquid cooling jacket for cooling the brush motor according to yet a further exemplary embodiment of the disclosure.

With reference to FIG. 23, in another embodiment, the cooling line 158 can include thermally conductive cooling jacket 168 that encloses a portion of the motor 64 or the jacket 160 enclosing the motor 64. The cooling jacket 168 has an inlet 170 in fluid communication with the pump 44 and an outlet 172 in fluid communication with the dispenser 38. The cooling jacket 168 can be made from aluminum, copper, or other high thermally-conductive material.

Figure 24:
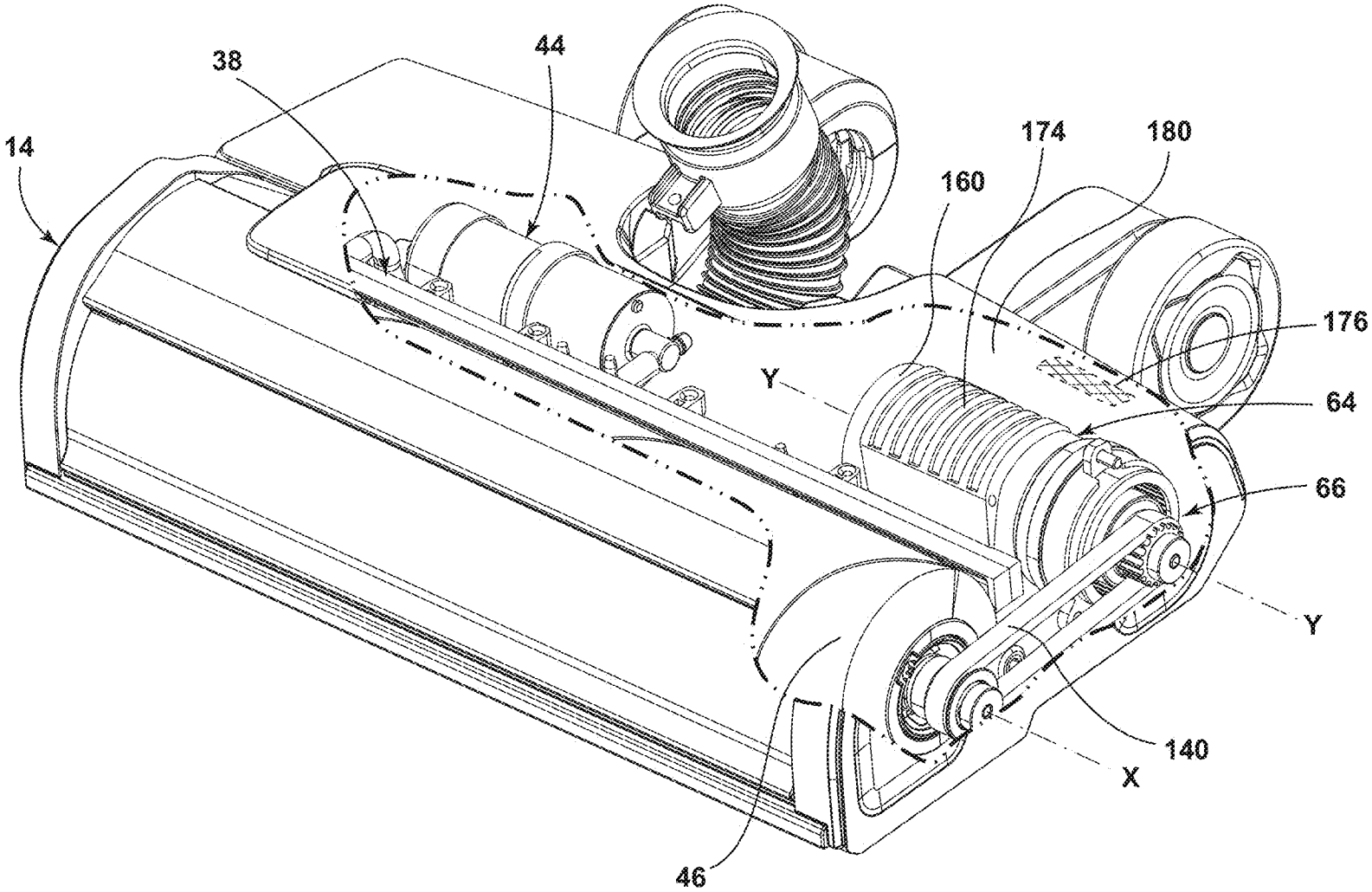
FIG. 24 is a perspective view of a cleaning base for the floor cleaner having an air cooling jacket for cooling the brush motor according to still a further exemplary embodiment of the disclosure.

Referring to FIG. 24, in an example of an air cooling system, the floor cleaner 10 can have an air-cooled heat exchange system that circulates air from the recovery system (FIG. 1) past the motor 64 to remove heat therefrom. The heat exchange system can include at least one air cooling jacket 174 that passes in close thermal contact with the motor 64 or the jacket 160 enclosing the motor 64, where the air cooling jacket 174 receives air from leaks of gaps in the base enclosure. Downstream of the air cooling jacket 174, the heated air joins the working air path 50 (FIG. 1) coupled with the suction source 54, optionally at a location downstream of the suction inlet port 60 and upstream of the suction source 54.

In the embodiments illustrated in FIGS. 18-24, the brushroll motor 64 and the associated thermal management component(s) are disposed within a cavity 180 in the base 14 of the floor cleaner 10. To facilitate heat transfer from this cavity 180, the base 14 can include one or more water-tight ventilation ports 176 (e.g., as shown in FIGS. 21 and 24). The one or more ventilation ports allow air into the portion of the base 14 containing the brushroll motor 64. The one or more ventilation ports 176 can comprise a screen mesh, for example a polypropylene mesh, for allowing airflow while preventing the ingress of dust, fine particles, and fluids into the interior of the base 14 of the floor cleaner 10. In these and other embodiments, the base 14 can include a housing formed of a thermally conductive material, including metals and thermally conductive plastics, to allow heat to escape the base 14.

In the above embodiments including an external cooling fan (e.g., as shown in FIGS. 18 and 20), the fan 154 may operate any time the scrub mode is activated, optionally for a predetermined period after the scrub mode is deactivated. During the standard cleaning mode, the external cooling fan 154 may not operate, or may operate only as needed to cool the motor 64. In the above embodiments including a stirring cooling fan 154 (e.g., as shown in FIGS. 19 and 21), since the fan 154 is attached to the shaft of the brushroll motor 64, it will operate any time the motor 64 is in operation.

In some embodiments, the floor cleaner 10 also includes a lockout feature for the scrub mode, and optionally for the standard cleaning mode. This lockout feature prevents damage to the brushroll motor 64 by interrupting the flow of power to the brushroll motor 64 based on thermocouple feedback. In particular, a thermocouple 178 (or other temperature sensor) can continuously monitor the temperature at or near the brushroll motor 64 and transmit a corresponding voltage signal to the central controller 32. The central controller 32 is programmed with a predetermined temperature threshold (i.e., the maximum allowable temperature for safe motor operation). As the motor operates, the central controller 32 compares the thermocouple's output (which is indicative of, and optionally proportional to, the motor temperature) against the predetermined temperature threshold. If the motor temperature exceeds the predetermined threshold, indicating an overheating condition, the central controller 32 triggers the lock-out mode. In the lock-out mode, the central controller 32 causes the motor controller 34 to interrupt power to the brushroll motor 64. For example, the scrub mode and/or the standard cleaning mode can be deactivated in response to a signal from the thermocouple 178 being indicative of a temperature above the predetermined temperature threshold. Deactivation of a mode can include terminating an in-progress mode or preventing the mode from initiating.

The floor cleaner 10 remains in the lock-out mode until the motor 64 cools to a safe temperature (as measured by the thermocouple 178), optionally including a predetermined time delay before a restart of the brushroll motor 64 is permitted. The predetermined temperature threshold is optionally a first threshold for the scrub mode and a second, higher threshold for the standard cleaning mode, such that the scrub mode is deactivated at a first temperature threshold (e.g., 50° C.) and the standard cleaning mode is deactivated a second, higher temperature threshold (e.g., 70° C.). In this aspect, the central controller 32 can provide a partial lock-out mode at a first temperature threshold (affecting only the scrub mode) and a complete lock-out at a second temperature threshold (affecting the scrub mode and the standard cleaning mode). In other embodiments, the central controller 32 provides a complete lock-out mode at the first temperature threshold (e.g., 50° C.), such that a second temperature threshold can be omitted entirely.

It is noted that throughout the figures, the floor cleaner 10 is illustrated as an upright device. However, it is understood that the scrub mode as described herein can be performed by other floor cleaners 10 and that the functional systems of the floor cleaner 10 can be arranged into any desired configuration, such as an upright device having a base and an upright body for directing the base across the surface to be cleaned, a portable device adapted to be hand carried by a user, a canister device having a cleaning implement connected to a wheeled base by a vacuum hose, an accessory tool configured for attachment to a vacuum hose, an autonomous or robotic device having an autonomous drive system and an autonomously moveable housing, or a commercial device. Thus, the present disclosure encompasses any of the aforementioned floor cleaners having the base 14 according to any embodiment described herein as the surface-engaging portion of the cleaner, having the brushroll 46 according to any embodiment described herein within the surface-engaging portion of the cleaner, and/or having the brushroll motor 64 according to any embodiment described herein for driving the agitator of the floor cleaner, or any combination thereof. Any of the aforementioned cleaners can include a flexible vacuum hose, which can form a portion of a conduit between a nozzle and a suction source.

While various aspects illustrated herein are shown on a multi-surface wet/dry vacuum cleaner, aspects of the present disclosure may be used on other types of surface cleaning apparatus, including, but not limited to, "wet" cleaners that deliver liquid, but do not use suction to collect debris and/or liquid, extraction cleaners that deliver a greater amount of liquid for deep cleaning a soft floor surface, and steam cleaners that generates steam by heating liquid to boiling for delivery to the surface to be cleaned. As used herein, the terms "wet/dry vacuum cleaner" or "wet/dry multi-surface cleaner" includes a vacuum cleaner that can be used to clean hard floor surfaces such as tile and hardwood, soft floor surfaces such as rugs and carpets, and other soft surfaces such as upholstery.

The terms "comprising" or "comprise" are used herein in their broadest sense to mean and encompass the notions of "including," "include," "consist(ing) essentially of," and "consist(ing) of. The use of "for example," "e.g.," "such as," and "including" to list illustrative examples does not limit to only the listed examples. Thus, "for example" or "such as" means "for example, but not limited to" or "such as, but not limited to" and encompasses other similar or equivalent examples.

The above description relates to general and specific embodiments of the disclosure. However, various alterations and changes can be made without departing from the spirit and broader aspects of the disclosure as defined in the appended claims, which are to be interpreted in accordance with the principles of patent law including the doctrine of equivalents. As such, this disclosure is presented for illustrative purposes and should not be interpreted as an exhaustive description of all embodiments of the disclosure or to limit the scope of the claims to the specific elements illustrated or described in connection with these embodiments. Any reference to elements in the singular, for example, using the articles "a," "an," "the," or "said," is not to be construed as limiting the element to the singular.

Likewise, it is also to be understood that the appended claims are not limited to express and particular compounds, compositions, or methods described in the detailed description, which may vary between particular embodiments that fall within the scope of the appended claims. With respect to any Markush groups relied upon herein for describing particular features or aspects of various embodiments, different, special, and/or unexpected results may be obtained from each member of the respective Markush group independent from all other Markush members. Each member of a Markush group may be relied upon individually and or in combination and provides adequate support for specific embodiments within the scope of the appended claims.

What is claimed is:

1. A surface cleaning apparatus comprising:

a housing including a suction inlet for drawing in liquid, debris and air, the housing being movable over a surface to be cleaned;

an agitator positioned within the housing and adjacent to the suction inlet, the agitator being configured to rotate in a first direction and in a second direction to agitate the surface to be cleaned;

a fluid delivery system configured to deliver a cleaning fluid toward at least one of the agitator and the surface to be cleaned;

a motor operably coupled to the agitator, the motor being configured to rotate the agitator in the first direction and in the second direction; and a controller configured to operate the surface cleaning apparatus in each of a standard cleaning mode and a scrub mode, the controller comprising a memory storing instructions that automatically executes the standard cleaning mode and the scrub mode;

wherein the controller responds to activation of the scrub mode by initiating a plurality of bi-directional cleaning cycles for debris removal;

wherein each of the plurality of bi-directional cleaning cycles includes:

rotation of the agitator in the first direction for a first predetermined time interval for at least a first plurality of revolutions, followed by a first braking interval, and counter-rotation of the agitator in the second direction for a second predetermined time interval for at least a second plurality of revolutions, followed by a second braking interval; and wherein the controller is operable to change at least one of a fluid delivery parameter and a suction parameter of the standard cleaning mode in response to activation of the scrub mode for providing agitation, cleaning fluid, and suction at the surface to be cleaned.

2. The surface cleaning apparatus of claim 1, wherein the fluid delivery system comprises a fluid dispenser and a pump in fluid communication with the fluid dispenser, wherein the fluid delivery parameter includes a flow rate of the cleaning fluid, and wherein changing the fluid delivery parameter includes increasing the flow rate of the cleaning fluid during operation of the scrub mode to a flow rate greater than that of the standard cleaning mode.

3. The surface cleaning apparatus of claim 1, comprising a vacuum motor in fluid communication with the suction inlet, wherein the suction parameter includes suction at the suction inlet, and wherein changing the suction parameter includes decreasing the suction at the suction inlet during operation of the scrub mode to lower suction than that of the standard cleaning mode.

4. The surface cleaning apparatus of claim 1, wherein changing the fluid delivery parameter and changing the suction parameter includes increasing fluid flow of the cleaning fluid and decreasing suction at the suction inlet.

5. The surface cleaning apparatus of claim 1, wherein:

the fluid delivery parameter includes a flow rate of the cleaning fluid and the suction parameter includes suction at the suction inlet; and in response to activation of the scrub mode, the controller is operable to increase dwell time of cleaning fluid on the surface to be cleaned by at least one of:

increasing the flow rate by at least 2×; and decreasing suction by at least 2×.

6. The surface cleaning apparatus of claim 1, wherein the motor is a brushless DC motor, the brushless DC motor being mechanically coupled to the agitator.

7. The surface cleaning apparatus of claim 1, wherein the first predetermined time interval is different than the second predetermined time interval such that a different portion of the agitator engages the surface to be cleaned at a beginning of each successive bi-directional cleaning cycle.

8. The surface cleaning apparatus of claim 1, wherein the controller is operable to rotate the agitator in the first direction at a first speed and counter-rotate the agitator in the second direction at a second speed, and wherein the first speed has a magnitude that is different than a magnitude of the second speed such that a different portion of the agitator engages the surface to be cleaned at a beginning of each successive bi-directional cleaning cycle.

9. The surface cleaning apparatus of claim 1, wherein:

the first and second predetermined time intervals are less than 0.5 seconds; and/or a ratio of the first predetermined time interval to the second predetermined time interval is 3:1 to 1.5:1.

10. The surface cleaning apparatus of claim 9, wherein the agitator is allowed to passively come to rest during the first and second braking intervals, the first and second braking intervals being between 10 and 200 milliseconds.

11. The surface cleaning apparatus of claim 1, comprising a fluid-cooled heat sink coupled to an exterior surface of the motor.

12. The surface cleaning apparatus of claim 11, wherein the fluid-cooled heat sink is an air-cooled heat sink including a plurality of fins extending from an arcuate sleeve on the exterior surface of the motor.

13. The surface cleaning apparatus of claim 11, comprising a cooling fan for circulating air over the fluid-cooled heat sink.

14. The surface cleaning apparatus of claim 11, wherein the motor is housed in a cavity within the housing, the housing including a ventilation port for open-loop circulation of air into the cavity.

15. The surface cleaning apparatus of claim 1, further comprising a height setter configured to adjust a height of the agitator relative to the surface to be cleaned in response to activation of the scrub mode for increasing engagement of at least a portion the agitator with the surface to be cleaned.

16. A method for cleaning a surface with a surface cleaning apparatus comprising:

providing a surface cleaning apparatus that is operable in a standard cleaning mode and in a scrub mode, the surface cleaning apparatus including a suction inlet, a fluid dispenser, a bi-directionally rotatable agitator to agitate a surface to be cleaned, and a motor operably coupled to the agitator; and in response to detecting activation of the scrub mode, oscillating the agitator forward and backward to scrub the surface to be cleaned, wherein oscillating the agitator comprises automatically switching the rotational direction of the agitator and performing a plurality of bi-directional cleaning cycles and changing at least one of a fluid delivery parameter and a suction parameter to provide agitation, cleaning fluid, and suction at a surface to be cleaned;

wherein each of the plurality of bi-directional cleaning cycles includes:

rotating the agitator in a first direction for a first predetermined time interval for at least a first plurality of revolutions, followed by a first predetermined braking interval, and counter-rotating the agitator in a second direction for a second predetermined time interval for at least a second plurality of revolutions, followed by a second predetermined braking interval.

17. The method of claim 16, comprising passively braking the motor during the first predetermined braking interval and during the second predetermined braking interval.

18. The method of claim 16, wherein:

the first predetermined time interval is different than the second predetermined time interval such that a different portion of the agitator engages the surface to be cleaned at a beginning of each successive bi-directional cleaning cycle.

19. The method of claim 16, wherein:

rotating the agitator in the first direction comprises rotating the agitator at a first speed;

counter-rotating the agitator in the second direction comprises rotating the agitator at a second speed; and the first speed has a magnitude that is different than a magnitude of the second speed such that a different portion of the agitator engages the surface to be cleaned at a beginning of each successive bi-directional cleaning cycle.

20. The method of claim 16, comprising directing a cooling fluid toward the motor.

21. The method of claim 20, wherein the cooling fluid is air, and the surface cleaning apparatus comprises a heat sink coupled to an exterior surface of the motor.

22. The method of claim 21, wherein a cooling fan circulates air over the heat sink, the cooling fan being physically coupled to the motor.

23. The method of claim 16, comprising:

measuring a temperature of the motor; and in response to the measured temperature exceeding a temperature threshold, deactivating the scrub mode.

24. The method of claim 16, wherein detecting activation of the scrub mode includes detecting a user input at a user interface.

25. The method of claim 16, comprising lowering a height of the agitator relative to the surface to be cleaned in response to detecting activation of the scrub mode.

26. The method of claim 16, wherein the surface cleaning apparatus comprises a fluid dispenser and a pump in fluid communication with the fluid dispenser, and in response to detecting activation of the scrub mode, changing the fluid delivery parameter by increasing a flow rate of the cleaning fluid to a flow rate greater than a flow rate of the standard cleaning mode.

27. The method of claim 16, wherein the surface cleaning apparatus comprises a vacuum motor in fluid communication with the suction inlet, and in response to detecting activation of the scrub mode, changing the suction parameter by decreasing suction at the suction inlet to a suction less than a suction parameter of the standard cleaning mode.

28. The method of claim 16, wherein changing at least one of a fluid delivery parameter and a suction parameter comprises increasing cleaning fluid flow to the surface to be cleaned and decreasing suction at the suction inlet.

29. The method of claim 16, wherein:

the surface cleaning apparatus comprises a vacuum motor in fluid communication with the suction inlet; and in response to detecting activation of the standard cleaning mode:

rotating the agitator in the first direction only; and operating a vacuum motor to ingest debris and/or fluid at the suction inlet.

30. A surface cleaning apparatus comprising:

a housing including a suction inlet for drawing in liquid, debris and air, the housing being movable over a surface to be cleaned;

an agitator positioned within the housing and adjacent to the suction inlet, the agitator being configured to rotate in a first direction and in a second direction to agitate the surface to be cleaned;

a fluid delivery system configured to deliver a cleaning fluid toward at least one of the agitator and the surface to be cleaned;

a motor operably coupled to the agitator, the motor being configured to rotate the agitator in the first direction and in the second direction;

a motor controller configured to provide presides electrical signals to the motor; and a central controller configured to operate the surface cleaning apparatus in each of a standard cleaning mode and a scrub mode;

wherein the central controller provides a speed control signal and a directional control signal to the motor controller in response to activation of the scrub mode;

wherein the central controller responds to activation of the scrub mode by initiating a plurality of bi-directional cleaning cycles for debris removal;

wherein each of the plurality of bi-directional cleaning cycles includes:

rotation of the agitator in the first direction for at least a first plurality of revolutions followed by a first braking interval, and counter-rotation of the agitator in the second direction for at least a second plurality of revolutions followed by a second braking interval;

wherein the central controller is operable to change at least one of a fluid delivery parameter and a suction parameter of the standard cleaning mode in response to activation of the scrub mode for providing agitation, cleaning fluid, and suction at the surface to be cleaned; and wherein the motor controller is operable to rotate the agitator in the first direction for a first predetermined time interval and counter-rotate the agitator in the second direction for a second predetermined time interval.

* * * * *